US011131963B2

(12) United States Patent
Ono et al.

(10) Patent No.: US 11,131,963 B2
(45) Date of Patent: Sep. 28, 2021

(54) PARTICLE COLLECTION SYSTEM WITH DISCHARGING ELECTRODE

(71) Applicant: HEWLETT-PACKARD DEVELOPMENT COMPANY, L.P., Spring, TX (US)

(72) Inventors: Manabu Ono, Yokohama (JP); Takashi Nakazawa, Yokohama (JP); Takeshi Kawamura, Yokohama (JP); Kensuke Nakajima, Yokohama (JP); Satoru Hori, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/961,161

(22) PCT Filed: Jan. 10, 2019

(86) PCT No.: PCT/US2019/013019

§ 371 (c)(1),
(2) Date: Jul. 9, 2020

(87) PCT Pub. No.: WO2019/140069

PCT Pub. Date: Jul. 18, 2019

(65) Prior Publication Data

US 2020/0363770 A1 Nov. 19, 2020

(30) Foreign Application Priority Data

Jan. 10, 2018 (JP) ..... JP2018-001765

(51) Int. Cl.

| | |
|---|---|
| ***G03G 21/20*** | (2006.01) |
| ***G03G 15/20*** | (2006.01) |
| ***G03G 21/18*** | (2006.01) |

(52) U.S. Cl.
CPC ..... *G03G 21/206* (2013.01); *G03G 15/2039* (2013.01); *G03G 21/1832* (2013.01)

(58) Field of Classification Search
None
See application file for complete search history.

(56) References Cited

U.S. PATENT DOCUMENTS

2003/0005824 A1* 1/2003 Katou ..... B03C 3/155 96/35
2012/0045243 A1 2/2012 Nishikawa
(Continued)

FOREIGN PATENT DOCUMENTS

CN 102314143 B 2/2015
JP 2010002803 1/2010
(Continued)

*Primary Examiner* — Sevan A Aydin
(74) *Attorney, Agent, or Firm* — Staas & Halsey, LLP

(57) ABSTRACT

A particle collection system of an imaging apparatus includes an air flow generation device to generate an air flow for transporting airborne particles, a charging device that is located upstream of the air flow generation device in a ventilation direction to charge the floating fine particles in the air flow, and a particle collection device that is located downstream of the charging device in the ventilation direction to collect the airborne particles which are charged by the charging device. The charging device includes a discharging electrode and a counter electrode, and the particle collection device includes a tubular ventilation passage. A length of the tubular ventilation passage in the ventilation direction is greater than an opening diameter of the tubular ventilation passage, and the opening diameter of the tubular ventilation passage is less than or equal to a gap between the discharging electrode and the counter electrode.

15 Claims, 10 Drawing Sheets

(56) References Cited

U.S. PATENT DOCUMENTS

| | | | | |
|---|---|---|---|---|
| 2012/0141173 | A1* | 6/2012 | Iwasaki | G03G 15/2025 399/327 |
| 2014/0079431 | A1* | 3/2014 | Orikasa | G03G 15/0258 399/92 |
| 2014/0119767 | A1* | 5/2014 | Inami | G03G 21/206 399/92 |
| 2014/0169825 | A1* | 6/2014 | Momomura | F24F 13/0245 399/92 |
| 2015/0261182 | A1* | 9/2015 | Katsumata | G03G 21/206 399/92 |
| 2017/0242397 | A1* | 8/2017 | Kudo | H05K 7/20136 |
| 2021/0063962 | A1* | 3/2021 | Nakazawa | B01D 46/0032 |

FOREIGN PATENT DOCUMENTS

| | | |
|---|---|---|
| JP | 2010029740 | 2/2010 |
| JP | 2013190651 A | 9/2013 |
| JP | 6188650 B2 | 8/2017 |

* cited by examiner

HONEYCOMB STRUCTURE

CORRUGATE STRUCTURE

FIG. 10

| | CONFIGURATION AND SETTING OF ELECTRIC DUST COLLECTION UNIT DISPOSED IN IMAGE FORMING APPARATUS | | | | | | | | | | | | | | | | | EVALUATION RESULT OF DISSIPATION AMOUNT TEST | | | |
|---|---|---|---|---|---|---|---|---|---|---|---|---|---|---|---|---|---|---|---|---|---|
| | ARRANGEMENT | VAPOR GENERATION UNIT | | CHARGING UNIT | | | DUST COLLECTION UNIT | | | | | | | VENTILATION STATE | | d/G | d×G | INITIAL DISSIPATION AMOUNT | | AFTER CONTINUOUS PRINTING | |
| | (*1) | HUMIDIFICATION DEVICE | WATER VAPOR SUPPLY RATE [mg/MINUTE] | CURRENT CONDUCTION AMOUNT (*2) [μA] | GAP G [mm] | RADIUS OF CURVATURE R (μm) | STRUCTURE | ELECTRET TREATMENT | LENGTH L [mm] | OPENING DIAMETER d [mm] | THICKNESS t [mm] | MATERIAL | CONTACT ANGLE [°] | VENTILATION SPEED [m/SECOND] | L/1000V | | | FLOATING FINE PARTICLES | OZONE | FLOATING FINE PARTICLES | OZONE |
| EXAMPLE 1 | A | ULTRASONIC TYPE | 0.30 | 90 →90 | 3.5 | 50 | CORRUGATE | PRESENCE | 20 | 0.9 | 0.1 | PP | 94 | 0.7 | 0.029 | 0.26 | 3.2 | A | A | A | A |
| EXAMPLE 2 | A | ULTRASONIC TYPE | 0.30 | 120 →120 | 5.0 | 50 | HONEYCOMB | PRESENCE | 10 | 0.9 | 0.1 | PP | 94 | 0.7 | 0.014 | 0.18 | 4.5 | A | A | A | B |
| EXAMPLE 3 | A | ULTRASONIC TYPE | 0.30 | 180 →180 | 2.5 | 125 | HONEYCOMB | PRESENCE | 5 | 0.5 | 0.05 | PP | 94 | 0.7 | 0.007 | 0.20 | 1.3 | C | B | C | B |
| EXAMPLE 4 | A | ULTRASONIC TYPE | 0.30 | 60 →200 | 12.5 | 7.0 | CORRUGATE | PRESENCE | 30 | 1.5 | 0.75 | PP | 94 | 0.7 | 0.043 | 0.12 | 19 | A | A | C | C |
| EXAMPLE 5 | A | ULTRASONIC TYPE | 0.30 | 180 →200 | 2.5 | 125 | HONEYCOMB | PRESENCE | 10 | 2.5 | 1.5 | PP | 94 | 0.7 | 0.014 | 1.00 | 6.3 | C | B | C | C |
| EXAMPLE 6 | A | ULTRASONIC TYPE | 0.30 | 60 →200 | 10 | 7.0 | HONEYCOMB | PRESENCE | 10 | 0.5 | 0.05 | PP | 94 | 0.7 | 0.014 | 0.05 | 5.0 | C | A | C | B |
| EXAMPLE 7 | A | ULTRASONIC TYPE | 0.30 | 120 →120 | 5.0 | 20 | HONEYCOMB | PRESENCE | 10 | 0.9 | 0.1 | PP | 94 | 0.7 | 0.014 | 0.18 | 4.5 | A | B | C | C |
| EXAMPLE 8 | A | ULTRASONIC TYPE | 0.30 | 60 →150 | 5.0 | 50 | CORRUGATE | PRESENCE | 10 | 0.9 | 0.1 | PET | 79 | 0.7 | 0.014 | 0.18 | 4.5 | C | A | A | C |
| EXAMPLE 9 | A | ULTRASONIC TYPE | 0.50 | 200 →200 | 5.0 | 50 | HONEYCOMB | PRESENCE | 10 | 0.9 | 0.1 | PE | 101 | 0.7 | 0.014 | 0.18 | 4.5 | A | B | B | B |
| EXAMPLE 10 | A | ULTRASONIC TYPE | 0.20 | 40 →40 | 5.0 | 50 | HONEYCOMB | PRESENCE | 10 | 0.9 | 0.1 | PP | 94 | 0.7 | 0.014 | 0.18 | 4.5 | C | C | C | C |
| EXAMPLE 11 | A | FIXING DEVICE | 0.30 | 90 →120 | 3.5 | 50 | CORRUGATE | PRESENCE | 4 ~20 | 0.9 | 0.1 | PP | 94 | 0.7 | 0.006 ~0.029 | 0.26 | 3.2 | A | A | A | A |
| COMPARATIVE EXAMPLE 1 | B | NONE | (0.10) | 60 →200 | 5.0 | 50 | HONEYCOMB | PRESENCE | 10 | 0.9 | 0.1 | PP | 94 | 0.7 | 0.014 | 0.18 | 4.5 | C | C | D | D |
| COMPARATIVE EXAMPLE 2 | A | NONE | (0.10) | 200 → – | 5.0 | 50 | HONEYCOMB | ABSENCE | 10 | 0.9 | 0.1 | PP | 94 | 0.7 | 0.014 | 0.18 | 4.5 | D | D | (STOPPED) | (STOPPED) |
| COMPARATIVE EXAMPLE 3 | A | NONE | (0.10) | 90 →200 | 15 | 15 | HONEYCOMB | PRESENCE | 10 | 0.5 | 0.1 | PP | 94 | 0.7 | 0.014 | 0.03 | 7.5 | C | C | D | D |
| COMPARATIVE EXAMPLE 4 | A | NONE | (0.10) | 200 → – | 2.0 | 50 | HONEYCOMB | PRESENCE | 10 | 2.5 | 0.1 | PP | 94 | 0.7 | 0.014 | 1.3 | 5 | D | D | (STOPPED) | (STOPPED) |
| COMPARATIVE EXAMPLE 5 | A | NONE | (0.10) | 200 → – | 15 | 50 | HONEYCOMB | PRESENCE | 3 | 1.5 | 0.1 | PP | 94 | 0.7 | 0.004 | 0.10 | 23 | D | D | (STOPPED) | (STOPPED) |
| COMPARATIVE EXAMPLE 6 | B | NONE | (0.10) | (APPLICATION OF NEGATIVE POLARITY) | – | (WIRE) | (HEPA) | ABSENCE | – | – | – | – | – | 0.05 | – | – | – | D | D | (STOPPED) | (STOPPED) |

*1) ARRANGEMENT FROM UPSTREAM SIDE IN VENTILATION DIRECTION, CASE A: IN ORDER OF CHARGING UNIT → COLLECTION UNIT → AIR FLOW GENERATION UNIT,
CASE B: IN ORDER OF AIR FLOW GENERATION UNIT → CHARGING UNIT → COLLECTION UNIT
*2) CURRENT CONDUCTION AMOUNT IN INITIAL DISSIPATION AMOUNT TEST → CURRENT CONDUCTION AMOUNT IN DISSIPATION AMOUNT TEST AFTER CONTINUOUS PRINTING

PARTICLE COLLECTION SYSTEM WITH DISCHARGING ELECTRODE

CROSS REFERENCE TO RELATED APPLICATIONS

This application is filed under 35 U.S.C. 0.371 as a National Stage of PCT International Application No. PCT/US2019/013019, filed on Jan. 10, 2019, in the United States Intellectual Property Office, which claims the priority benefit of Japanese Patent Application No. 2018-001765, filed on Jan. 10, 2018, in the Japan Patent Office, the disclosures of both of which are incorporated by reference herein in their entirety.

BACKGROUND

An imaging system may use an electrophotographic method, in which a photoreceptor is charged, and then an electrostatic latent image is formed on the photoreceptor. The electrostatic latent image is developed, and a toner image is formed on the photoreceptor. The toner image that is obtained is transferred to a transfer material such as paper, and is fixed onto the transfer material.

BRIEF DESCRIPTION OF DRAWINGS

FIG. 10 is a table illustrating setting conditions and results of an example dissipation amount test.

DETAILED DESCRIPTION

Figure 1:
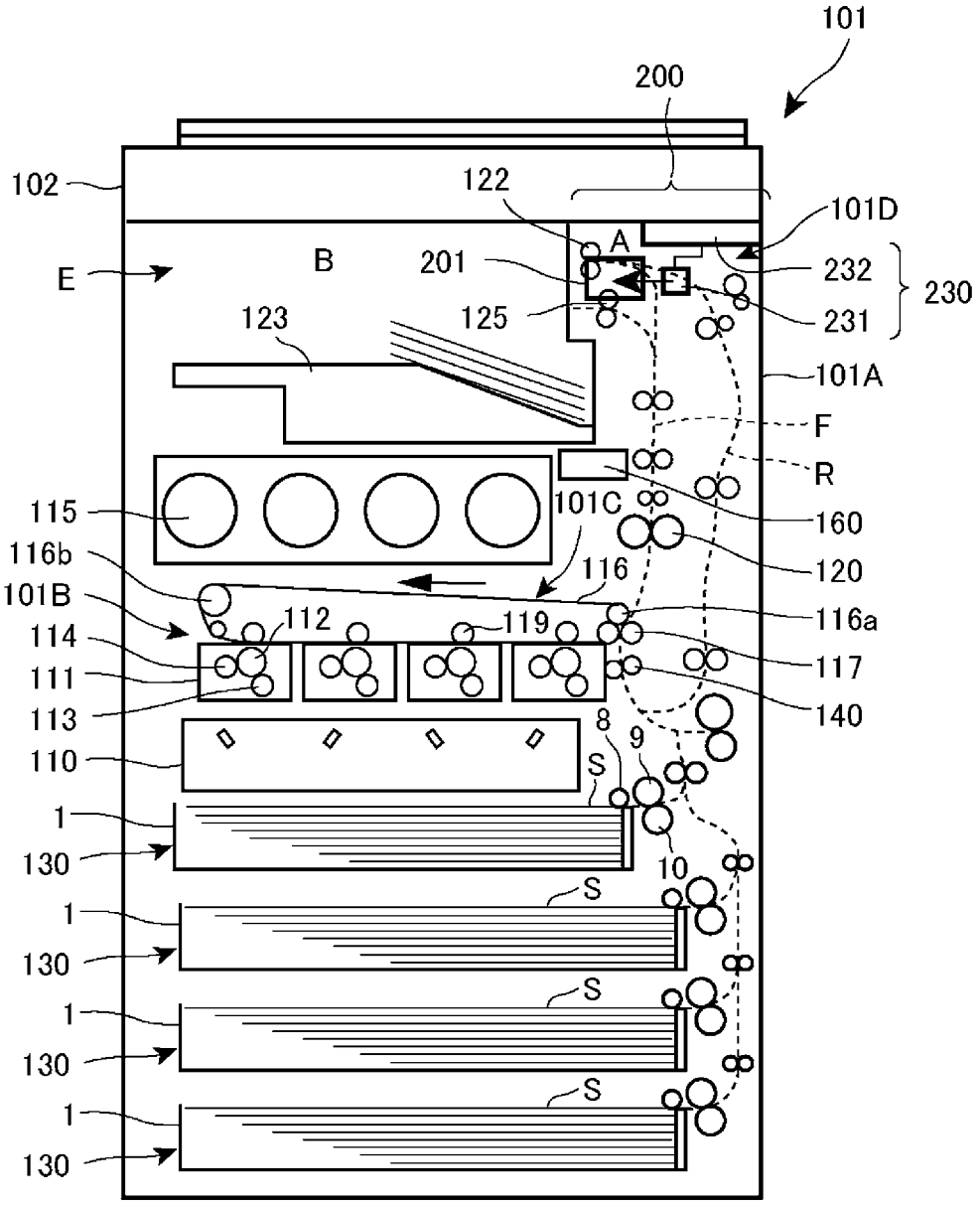
FIG. 1 is a schematic view illustrating an example image forming apparatus.

In the following description, with reference to the drawings, the same reference numbers are assigned to the same components or to similar components having the same function, and overlapping description is omitted. It is to be understood that not all aspects, advantages and features described herein may necessarily be achieved by, or included in, any one particular example. Indeed, having described and illustrated various examples herein, it should be apparent that other examples may be modified in arrangement and detail is omitted.

The productivity of an image forming apparatus may be determined by an image forming speed, and an operation time of the apparatus. Accordingly, speeding-up of image formation, and lengthening of an operational time (shortening of a stopping time) may be used to increase productivity.

The fixing device or an ambient temperature inside the image forming apparatus (referred to as "in-apparatus temperature") may experience a rise in temperature and become heated. For example, a residence time in a pressure contact portion when the transfer material passes through the inside of the fixing device may be shortened due to the speeding-up of the image forming, and thus a setting temperature of the fixing device may be set to higher to fix the toner image. In addition, the amount of heat per unit time, which is transferred to the transfer material from the fixing device, also increases due to the lengthening of the operational time, and the fixing device may be continuously maintained at an operating temperature when continuously heating the fixing device. As a result, the in-apparatus temperature of the fixing device and the periphery of the fixing device may increase.

The increase in-apparatus temperature of the fixing device and periphery may result in the occurrence of floating fine particles (e.g., airborne particles) at the inside of the image forming apparatus. The floating fine particles have a particle size of approximately 50 to 300 nm, and exist inside the apparatus in a floating state. For example, the floating fine particles are formed when a chemical material, is cooled down at the inside of the apparatus. In some examples, the chemical material is dissipated when a developer (toner) that is used in the image forming apparatus and various members such as a pressure roller that is used in the fixing device are heated.

The image forming apparatus may have a structure in which heat generated inside the image forming apparatuses is exhausted to the outside of the apparatuses to stabilize image formation. Accordingly, the floating fine particles which are located inside the image forming apparatuses are likely to be dissipated to the outside of the apparatuses during heat exhaustion, and may have an influence on the indoor air quality at the periphery of the image forming apparatuses. In addition, in a case where the floating fine particles form a residue inside of the image forming apparatuses, the floating fine particles may affect an image forming process. For example, the floating fine particles may adhere to an exposure device such as a laser beam transmitter and create image forming issues. In addition, floating fine particles which adhere to an electric component may result in image control and contact issues. Additionally, floating fine particles which adhere to a rubber conveying roller that conveys transfer paper may affect a transfer material process. The effects of floating fine particles may be more pronounced for image forming apparatuses which have been reduced in size.

An example image forming apparatus with reduced floating fine particles is herein disclosed. The image forming apparatus may include an electrostatic dust collection unit having a configuration in which air that contains ultra-fine particles (UFP) occurred from heating and fixing device, and the like, is suctioned by using a blowing fan provided at an inlet of an exhaust duct. The UFP are blown toward a discharging electrode provided inside the exhaust duct to charge the UFP and the like. Additionally, the charged UFP are collected by a dust collection electrode that is provided at an exhaust port of the exhaust.

The floating fine particles are removed from the air, but the amount of air that is processed (hereinafter, referred to as "air throughput") may be as small as 10 L/min. When increasing the air throughput, a deviation of a wind speed in blowing toward the discharging electrode, or a passing state to the discharging electrode occurs, and a deviation occurs in a charging state of the floating fine particles in the air. As a result, the collection efficiency at the dust collection electrode may be significantly lowered.

The image forming apparatus may include an electrostatic dust collection unit may have an exhaust duct divided into two parts. In some examples, one of the two parts is provided with a discharging electrode to which a positive-polarity high voltage is applied, and the other part is provided with a discharging electrode to which a negative-polarity high voltage is applied. Additionally, the UFP passing through each of the discharging electrodes are charged and are merged, and the merged UFP are collected with an air filter that is provided at an outlet of the exhaust duct The air throughput for each discharging electrode may be reduced by approximately half, and thus a charged state of the UFP in the air is improved. In addition, the UFP charged to a positive polarity and the UFP charged to a negative polarity are mixed and are electrostatically collected to facilitate a collection of the floating fine particles. However, the structure of the exhaust duct may be complex, and a new power supply unit that applies the high voltage to each of the positive discharging electrode and the negative discharging electrode may increase the size and cost of the image forming apparatus. In addition, the UFP charged to the positive polarity and the UFP charged to the negative polarity behave as an aggregate due to electrostatic aggregation, and thus a charging amount of the aggregate may be neutralized. Accordingly, an air filter using "inertial collision" or "blocking effect" may be used to collect the aggregate. However, in a case where the air filter is provided at an outlet of the exhaust duct, a large pressure loss occurs, and a pleating of the air filter and additional arrangement of a cyclone type solid-gas separation device and the like may be used, resulting in an even larger image forming apparatus.

Furthermore, the image forming apparatus that uses the electrostatic dust collection unit as described may result in the generation of ozone in the charging unit which may affect the performance due to current conduction deterioration (energization deterioration) of the discharging electrode.

An air filter with a low pressure loss may include a structure manufactured by continuously folding or bending an electreted polymer film, and stacking the polymer film to form a plurality of continuous voids.

The air filter having the polymer film structure can suppress a pressure loss to a low value in order to use a small-sized thin air blower. However, collection capability by the inertia collision or the blocking effect decreases in proportion to the suppression of the pressure loss, and thus trapping of the floating fine particles is mainly performed by "diffusion" or "electrostatic adsorption". Accordingly, in a case where a passing speed of air including the floating fine particles is fast, or a charged state of the floating fine particles is weak, the floating fine particle collection efficiency may significantly decrease.

An ion generator configured to remove offensive odor or a volatile organic compound (VOC) may be located inside the image forming apparatus.

Ions generated by the ion generator of a corona discharging type using a needle-shaped discharging electrode or a surface discharging type using a serrated (sawtooth) shaped planar electrode are discharged toward a fixing nip portion that is a generation source of the offensive odor or the VOC to directly remove the offensive odor or the VOC. To promote removal of the offensive odor or the VOC, a water vapor that evaporates from a sheet heated during fixing is used, and a temperature of the ion generator is raised to 80° C. by using heat of a fixing heater to suppress generation of ozone that is to be thermally decomposed. The amount of ozone generated, which is described below, may be approximately 0.494 ppm (1 mg/m$^3$) for five minutes, which may affect the indoor air quality at the periphery of the image forming apparatus and the like. In addition, the ion generator may be operated with a voltage as high as several kV at a high temperature state.

An example image forming apparatus is disclosed herein, having a reduced amount of floating fine particles.

The image forming apparatus may be configured to efficiently collect floating fine particles which occur inside the image forming apparatus to prevent a dissipation of the floating fine particles to the outside of the image forming apparatus, or to prevent the occurrence of the floating fine particles at the inside of the apparatus.

An air flow passing through a charging unit and a dust collection unit of an electrical dust collection unit provided in the image forming apparatus may be controlled to increase the effective collection of floating fine particles in the air and an air throughput. In addition, a water vapor supplied to the charging unit may be used to maintain/continue the collection of floating fine particles and the air throughput.

In some examples, an image forming apparatus may include an electric dust collection unit (or particle collection system) including at least an air flow generation unit that generates an air flow for transporting floating fine particles, a charging unit that is disposed upstream of the air flow generation unit in a ventilation direction and charges the floating fine particles in the air flow, and a dust collection unit that is disposed downstream of the charging unit in the ventilation direction and collects the floating fine particles which are charged by the charging unit. The charging unit includes at least a discharging electrode to which a high voltage is applied by a high-voltage power supply (high-voltage power source), and a flat plate-shaped counter electrode that is disposed in parallel to both lateral surfaces of the discharging electrode and is grounded. The dust collection unit includes at least a structure (hereinafter, referred to as "structure including a tubular ventilation passage") including a tubular ventilation passage (tubular ventilation flue) that is formed by stacking polymer sheets which are subjected to electret treatment. A length L (mm) of the tubular ventilation passage in the ventilation direction and an opening diameter d (mm) of the tubular ventilation passage satisfy a relationship of $L>d$. The opening diameter d (mm) of the tubular ventilation passage satisfies relationships of $d/G=0.05$ to 1.0 and $d\times G<20$ with respect to a gap G (mm) between the discharging electrode and the counter electrode.

Since the charging unit including the flat plate-shaped counter electrode is disposed upstream of the air flow generation unit in the ventilation direction, air flow rectified by each space that is partitioned with the counter electrode is introduced, and the floating fine particles in the air flow can be uniformly and efficiently charged. In addition, since the dust collection unit is set to a structure including the tubular ventilation passage, the air flow partitioned in the charging unit may be continuously treated. In addition to the relationship between the length L of the tubular ventilation passage and the opening diameter d, the relationship with the gap G between the discharging electrode and the counter electrode may be particularly determined in order to realize high collection efficiency without lowering an air throughput.

In addition, a water vapor may be supplied to the charging unit to suppress the amount of ozone generated. Accordingly, an electrostatic dust collection unit may be provided in the image forming apparatus while avoiding an influence on air quality at the periphery of the image forming apparatus or ozone deterioration inside the image forming apparatus.

In some examples, the electric dust collection unit further includes a water vapor generation unit that supplies a water vapor to the charging unit, and a supply rate of the water vapor that is supplied from the water vapor generation unit is set to 0.20 to 0.50 mg/minute per 1 $cm^2$ of cross-sectional area of a wind path that passes through an electrode portion of the charging unit. Since the supply rate of the water vapor is set within the above-described range, current conduction deterioration of the discharging electrode is suppressed to prevent deterioration of collection efficiency due to over-humidity of a collection portion in advance.

In some example electrophotographic methods, a fixing device that heats, presses, and fixes a developer on a transfer material may also function as the vapor generation unit.

The fixing device may function as the water vapor generation unit to reduce the size of the image forming apparatus. Additionally, water vapor that is generated from the transfer material can be used in place of a water feeding unit, to reduce water feeding time.

In some example electrophotographic methods, the discharging electrode may include protrusions for discharging at even intervals, and a tip end shape of each of the protrusions may have a radius of curvature that is greater than an average diameter of a developer.

Since the radius of curvature of the tip end of the discharging electrode is set to be greater than the average diameter of a developer, electrostatic adhesion of the developer to the tip end is mitigated, a deviation of an application voltage for corona formation along with current conduction deterioration is suppressed, and an influence on charging of the floating fine particles can be minimized.

In some example electrophotographic methods, the high voltage applied to the discharging electrode has a polarity opposite to a charging polarity of a developer, and the voltage is controlled so that a current conduction amount between the discharging electrode and the counter electrode becomes a predetermined amount.

Since the high voltage applied to the discharging electrode has a polarity opposite to a charging polarity of a developer, a high-voltage application device can be used inside the image forming apparatus to prevent an increase in size of the image forming apparatus in advance.

In some example electrophotographic methods, an ejection and conveyance path of the transfer material for which image formation is terminated also functions as an introduction route of the air flow for transporting the floating fine particles.

Accordingly, the floating fine particles which occur at the periphery of the fixing device may be introduced into the electric dust collection unit in a high concentration to realize a volume reduction of the air throughput in the electric dust collection unit. Accordingly a reduction in size of the electric dust collection unit may be realized.

In some examples, the air flow passing through the charging unit and the dust collection unit of the electric dust collection unit provided inside the image forming apparatus is controlled, and the water vapor is supplied to the charging unit, to provide an image forming apparatus which collects the floating fine particles which occur inside the image forming apparatus with high efficiency to prevent a dissipation of the floating fine particles to the outside of the image forming apparatus or an accumulation of the floating fine particles at the inside of the apparatus.

FIG. 1 is a view illustrating a schematic configuration of an example image forming apparatus 101, such as a color multifunctional machine, that may use an electrophotographic method. By way of providing an example illustration, the image forming apparatus 101 will be described with respect to a full color laser beam printer (hereinafter, referred to as "printer"). Accordingly, a printer main body 101A (apparatus main body) may be an image forming apparatus main body, and an image forming unit 101B (e.g., image forming device) may form forms an image on a sheet. An image reading device 102 may be provided approximately horizontally on an upper side of the printer main body 101A, and an ejection space E for sheet ejection is formed between the image reading device 102 and the printer main body 101A.

A sheet feeding device 130 may be detachably attached to the printer main body 101A, and may feed a sheet S from a paper feeding cassette 1 that is a sheet storage unit (e.g., sheet storage device) that stores the sheet S, and the paper feeding cassette 1. The sheet feeding device 130 includes a pickup roller 8 that is a sheet feeding unit (e.g., sheet feeding device), and a separation unit (e.g., separation device) including a feed roller 9 and a retard roller 10 that separate the sheet S transported from the pickup roller 8.

The image forming unit 101B (imaging forming section) is a four-continuous-drum full color type, and includes a laser scanner 110, and four process cartridges 111 which form a toner image of four colors of yellow (Y), magenta (M), cyan (C), and black (K). Here, each of the process cartridges 111 includes a photosensitive drum 112, a charging unit 113 (e.g., charging device) that is a charging portion, and a development unit 114 (e.g., development device) that is a development portion. In addition, the image forming unit 101B includes an intermediate transfer unit 101C (e.g., intermediate transfer device) and a fixing unit 120 (e.g., fixing device) which are disposed on an upward side of the process cartridge 111. Furthermore, a toner cartridge 115 supplies a toner to the developer 114.

The intermediate transfer unit 101C includes an intermediate transfer belt 116 that is wound around a driving roller 116*a* and a tension roller 116*b*. Furthermore, a primary transfer roller 119, which comes into contact with the intermediate transfer belt 116 at a position that faces the photosensitive drum 112, is provided on an inner side of the intermediate transfer belt 116. Here, the intermediate transfer belt 116 is rotated by the driving roller 116*a* that is driven by a driving unit (e.g., driving device, not illustrated) in an arrow direction.

In addition, multiple toner images of respective colors on the photosensitive drum are sequentially transferred (multiple-transferred) to the intermediate transfer belt 116 by the primary transfer roller 119. A secondary transfer roller 117, which transfers a color image formed on the intermediate transfer belt to the sheet S, is provided at a position that faces the driving roller 116*a* of the intermediate transfer unit 101C. In addition, the fixing unit 120 is disposed above the secondary transfer roller 117, and an ejection roller pair 125 and a double-side reversing unit 101D (e.g., double-side reversing device) are disposed on an upper-left side of the fixing unit 120. The double-side reversing unit 101D is provided with a reversing roller pair 122 that can rotate in forward and reverse directions, and a reconveying passage R along which a sheet in which an image is formed on one surface is conveyed again to the image forming unit 101B, and the like. Furthermore, in FIG. 1, a control device 160 or control unit (operation unit) controls an image forming operation, a sheet feeding operation, and the like.

Next, an example image forming operation of the printer 101 will be described. Image information of an original document is read by the image reading device 102, the image information is subjected to image processing to be converted into an electrical signal, and the electrical signal is transmitted to the laser scanner 110 of the image forming unit 101B. At the image forming unit 101B, a surface of the photosensitive drum 112, which is uniformly charged to a predetermined polarity and a predetermined potential by the charging unit 113, is sequentially exposed by laser light. Accordingly, electrostatic latent images of yellow, magenta, cyan, and black are sequentially formed on photosensitive drums of the respective process cartridges 111.

Next, the electrostatic latent images are developed and visualized by respective colors of toners charged to a negative polarity, and toner images of respective colors on the respective photosensitive drums are transferred to the intermediate transfer belt 116 in a sequentially superimposed manner by a primary transfer bias (for example, 20 μA/+1.5 to 2 kV) that is applied to the primary transfer roller 119 and has a positive polarity. Accordingly, a toner image is formed on the intermediate transfer belt 116. In addition, the sheet S is transported from the pickup roller 8 provided in the sheet feeding device 130 in combination with the toner image forming operation. A plurality of the transported sheets S are separated sheet by sheet by a separation unit (e.g., separation device) including the feed roller 9 and the retard roller 10, and are conveyed to a registration roller pair 140, and skew of each of the sheets is corrected by the registration roller pair 140.

After the skew is corrected, the sheets S is conveyed to the secondary transfer unit by the registration roller pair 140, and a toner image is collectively transferred onto the sheet S by a secondary transfer bias (for example, 30 μA/+1 kV) applied to the secondary transfer roller 117 in the secondary transfer unit. Next, the sheet S to which the toner image is transferred is conveyed to the fixing unit 120, and heat and pressure are applied to the sheet S in the fixing unit 120. Accordingly, the respective colors of toners are melted and color mixing occurs, and the toners are fixed to the sheet S as a color image.

Next, the sheet S to which the image is fixed is ejected to an ejection space S by the ejection roller pair 125 provided downstream of the fixing unit 120 and is loaded at a loading unit 123 (e.g., loading device) projecting at a base portion of ejection space S. Furthermore, when forming an image on both sides of the sheet S, after the image is fixed, the sheet S is conveyed along a transfer material reverse route R (hereinafter, referred to as "reverse route R") by the reversing roller pair 122, and is conveyed again to the image forming unit 101B.

In FIG. 1, an electric dust collection unit 200 (e.g., dust collection system or particle collection system) includes a main body portion 201 including an air flow generation unit (e.g., air flow generation device), a collection unit (e.g., collection device), and a charging unit (e.g., charging device). Additionally, the electric dust collection unit 200 includes a water vapor generation unit 230 (e.g., water vapor generation device) that supplies a water vapor to a charging unit 220 (e.g., charging device). The water vapor generation unit 230 includes a humidification device 231 and a water feeding tank 232 that is connected to the humidification device 231. A transfer material conveying route F (hereinafter, "paper ejection route F") is located between the fixing unit 120 to which the sheet S for which image formation is terminated is conveyed and the ejection roller pair 125. Additionally, a reverse route R may be associated with performing image formation on both a front surface and a rear surface of the sheet S. The main body portion 201 is disposed between the transfer material conveying route F and the reverse route R. In addition, the humidification device 231 is disposed on a side opposite to the main body portion 201 with the paper ejection route F interposed therebetween. The humidification device 231 is configured to transpire a water vapor in a direction of an arrow in a period from a time immediately after the sheet S is conveyed to the reverse route R to a time immediately before the subsequent sheet S passes.

In some examples, the paper ejection route F also functions as an air flow introduction route for transporting the floating fine particles to the electric dust collection unit 200. In a state in which a transfer material does not exist, the paper ejection route F forms a certain extent of space, and communicates with the inside of the image forming apparatus from right to left or up and down. However, when the sheet S continuously moves on the paper ejection route F, the space partitioned by the sheet S, and air in the vicinity of a surface of the sheet S moves in a movement direction of the sheet S due to Bernoulli's effect. Accordingly, air may be selectively introduced at the periphery of the fixing unit 120 to the electric dust collection unit 200. Furthermore, when productivity of the image forming apparatus is raised, a time for which the sheet S exists on the paper ejection route F is lengthened, and a velocity of the air flow that is generated also increases, and thus paper ejection route F may function as a duct. As a result, floating fine particles which occur at the periphery of the fixing unit 120 may be introduced to the electric dust collection unit 200. For example, the floating fine particles that are located inside the image forming apparatus may be transferred to the electric dust collection unit 200.

Figure 2A:
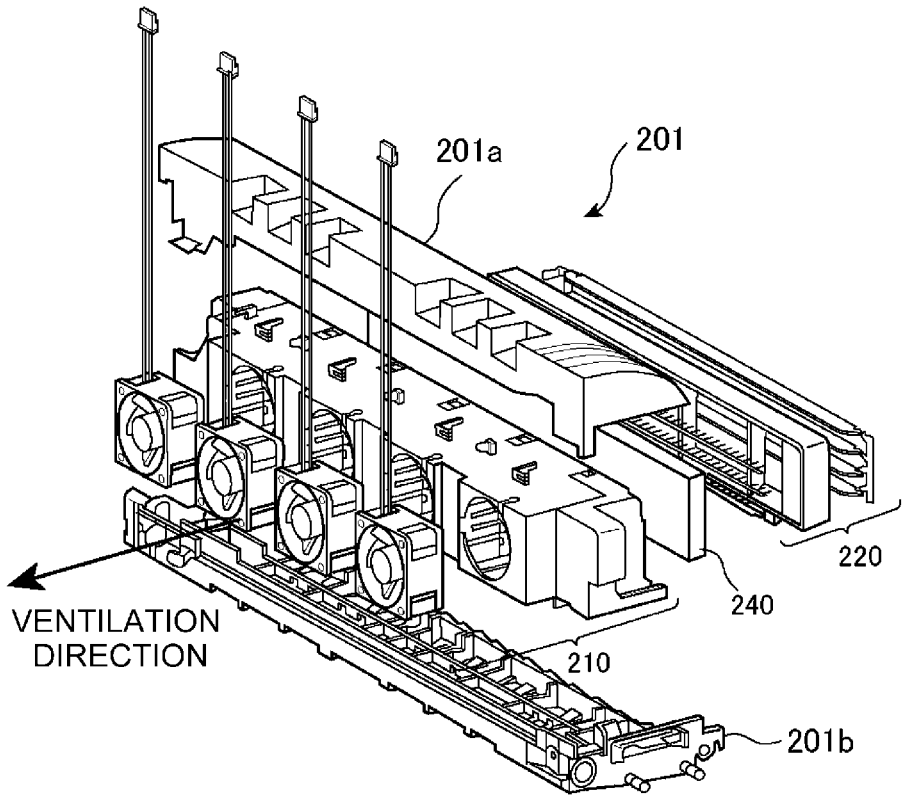
FIG. 2(*a*) is an exploded perspective view of a main body portion of an example electric dust collection system and FIG. 2(*b*) is a cross-sectional view thereof.
Figure 2B:
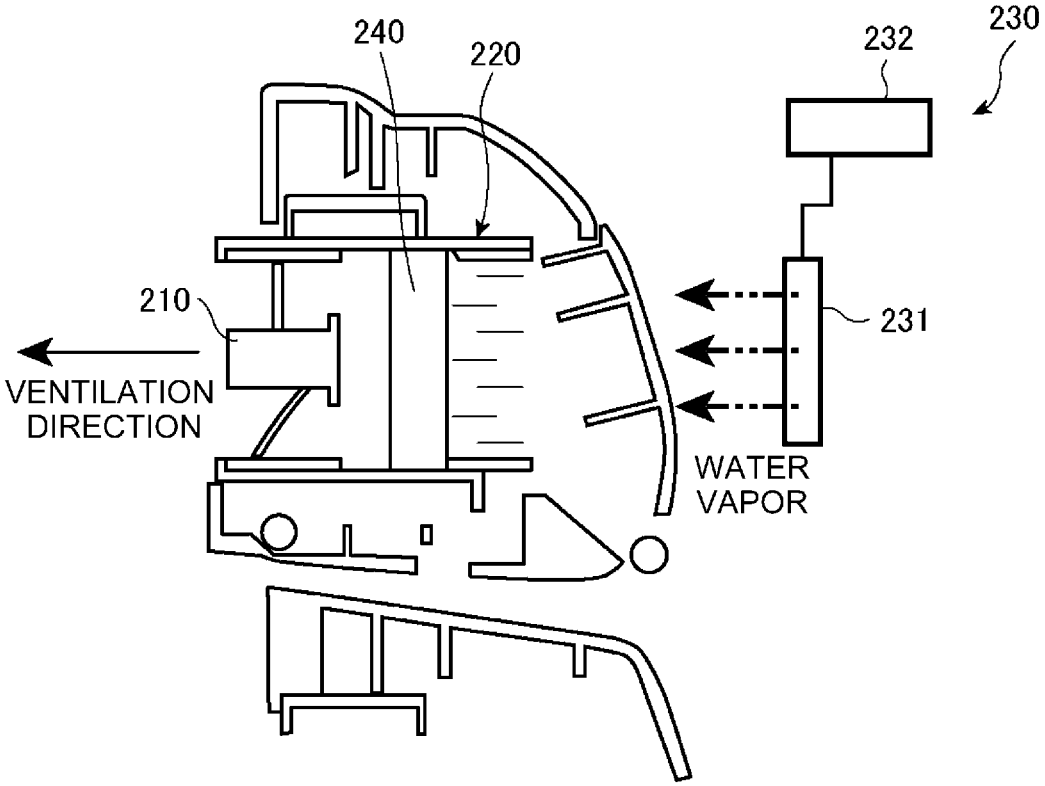

FIG. 2(*a*) is an exploded perspective view of the main body portion 201 and FIG. 2(*b*) is a cross-sectional view thereof. The main body portion 201 includes an air flow generation unit 210 (e.g., air flow generation device) that generates an air flow for transporting floating fine particles, and the charging unit 220 that is disposed upstream of the air flow generation unit 210 in the ventilation direction and charges the floating fine particles in the air flow. Additionally, the main body portion 201 includes a water vapor generation unit 230 (e.g., water vapor generation device) that supplies water vapor to the charging unit 220, and a dust collection unit 240 (e.g., dust collection device) that is disposed downstream of the charging unit 220 in the ventilation direction and collects the floating fine particles charged by the charging unit 220. The main body portion 201 includes an upper transfer material conveying guide 201*a* and a lower transfer material conveying guide 201*b* which also function as a housing that accommodates the above described constituent units. In addition, the electric dust collection unit 200 includes the water vapor generation unit 230 that supplies a water vapor to the charging unit 220.

In some examples, the air flow generation unit 210 may comprise an axial flow blower including a propeller fan. The ventilation direction is indicated by an arrow in the drawings, and air inside the image forming apparatus is suctioned by the blower and is introduced to the inside of the electric dust collection unit 200. In contrast to a rotational flow that occurs on an ejection side of the blower, an air flow that occurs on a suction side of the blower is relatively uniform. Accordingly, the floating fine particles in the air flow are uniformly charged, and the floating fine particles which are charged can be distributed with respect to a wind receiving surface of the dust collection unit 240 at an appropriate wind velocity. Examples of a blower that may be included in the air flow generation unit 210 are, for example, an axial flow blower including a propeller fan, a centrifugal blower including a multi-blade fan or a turbo fan, a diagonal flow blower including a diagonal fan, a transverse flow blower (cross-flow blower) including a cross flow fan, or the like.

Figure 3A:
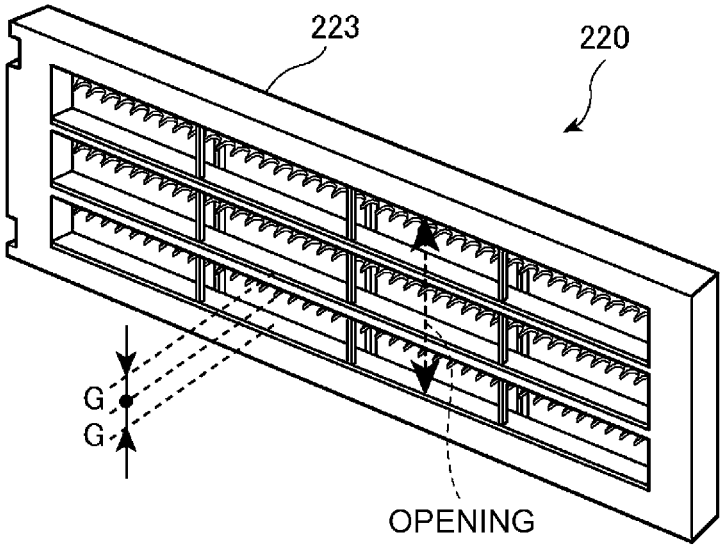
FIG. 3(*a*) is an enlarged view of a main portion of an example charging unit of the electric dust collection system, and FIG. 3(*b*) is an exploded perspective view thereof.
Figure 3B:
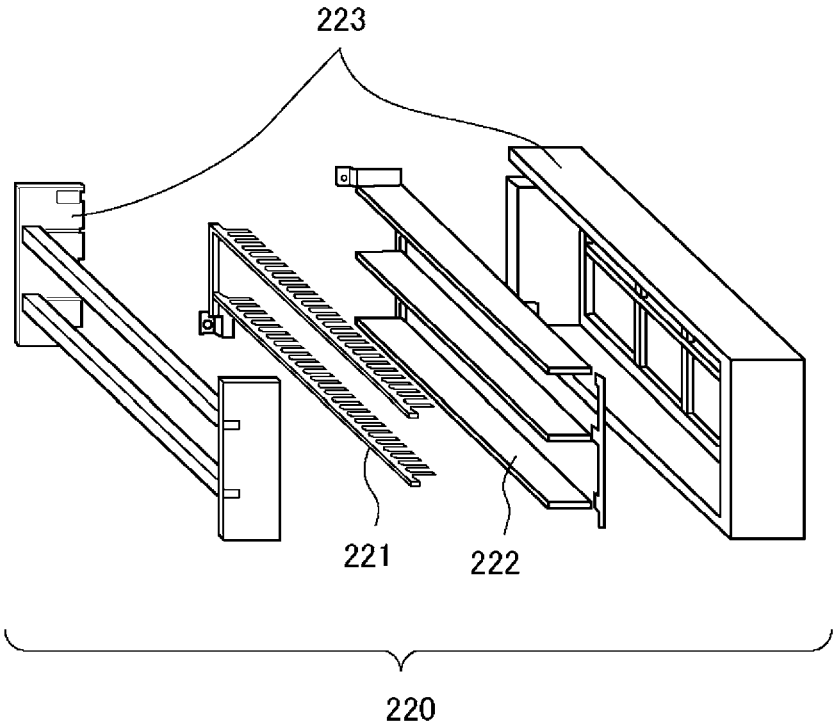

FIG. 3(*a*) is an enlarged view of a main portion of the charging unit 220, and FIG. 3(*b*) is an exploded perspective view thereof. The charging unit 220 includes at least a discharging electrode 221 to which a high voltage is applied by a high-voltage power supply (not illustrated), and a flat plate-shaped counter electrode 222 that is grounded. The counter electrode 222 is disposed in parallel to both lateral surfaces of the discharging electrode 221 with a gap G (mm) and is provided in an electrode casing 223.

An opening (aperture) of the charging unit 220 is partitioned by the flat plate-shaped counter electrode 222 for each length (G×2) that is two times the gap G. As a result, charging with respect to the floating fine particles in the air flow may be uniformly performed for every partition. The gap G may be set in a range of 2 to 15 mm. In a case where the gap G is less than 2 mm, an influence of the thickness of the discharging electrode 221 or the counter electrode 222 may affect the ability to secure an opening of the charging unit 220. In addition, in a case where the gap G is greater than 15 mm, the effect of partitioning the opening of the charging unit 220 by the flat plate-shaped counter electrode 222 is lost, resulting in a higher voltage to be applied, or the influence of current conduction deterioration of the electrode may become an issue. When the number of sheets of the counter electrode is adjusted to set the gap G within the above-described range, the opening of the charging unit 220 may be divided, and this contributes to charging to the floating particles.

Figure 4:
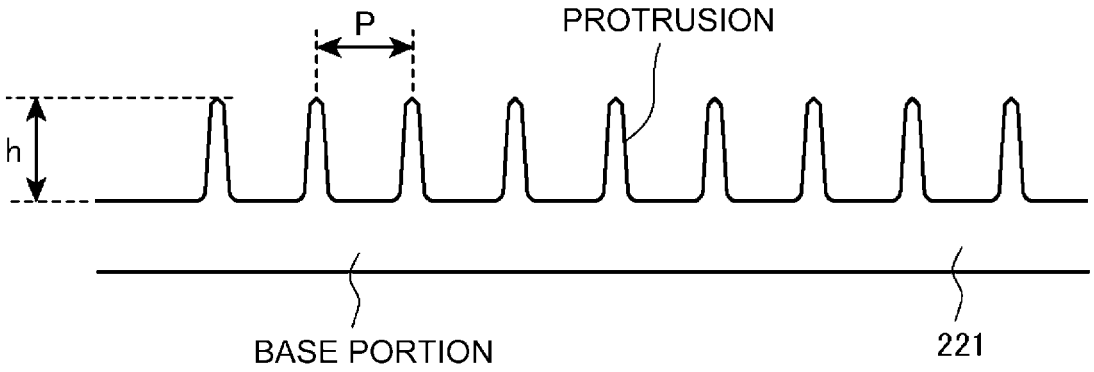
FIG. 4 is a view illustrating an external appearance of an example discharging electrode.

In some examples, the discharging electrode includes protrusions for discharging at even intervals, and a tip end shape of each of the protrusions has a radius of curvature that is greater than an average diameter of a developer. The protrusion may be processed into a serrated shape or a needle shape. FIG. 4 is a view illustrating an example external appearance of the discharging electrode 221 including the serrated shaped protrusions, and the discharging electrode 221 includes serrated shaped "protrusions" having a height h at a flat plate-shaped "base portion" at an interval P (mm). The dimensions of the height h and the interval P of the protrusions may be set in a range of 90% to 110% of the gap G between the discharging electrode and the counter electrode to facilitate charging of the floating fine particles.

A predetermined voltage is applied to the base portion of the discharging electrode 221 from a high-voltage power supply (not illustrated), and the tip end of the protrusions (hereinafter, referred to as "electrode tip end") forms corona, and performs charging to the floating fine particles in the air flow. The degree of charging to the floating fine particles can be controlled by a current conduction amount (energization amount) between the discharging electrode and the counter electrode (hereinafter, referred to 37 inter-electrode current conduction amount).

Charging of the floating fine particles in the air flow, at the electrode tip end, may result in an increase in resistance proceeds due to oxidation of a constituent material of the electrode tip end, or an increase in adhesion of a chemical substance that is mixed in the air flow. When this "current conduction deterioration" proceeds, a relatively larger application voltage may be used to maintain initial corona formation.

The degree of the current conduction deterioration of the discharging electrode is susceptible to the inter-electrode current conduction amount, a current conduction time, the amount of impurities in a constituent material of the electrode, a processing state, an adhesion frequency of the chemical substance, and the like, and thus the degree of the current conduction deterioration may be different for each electrode tip end. This tendency may occur as a result of being mounted on an electrophotographic image forming apparatus in which a developer (toner) and a component that constitutes the developer (for example, a floating additive) are mixed in the air flow.

Figure 5:
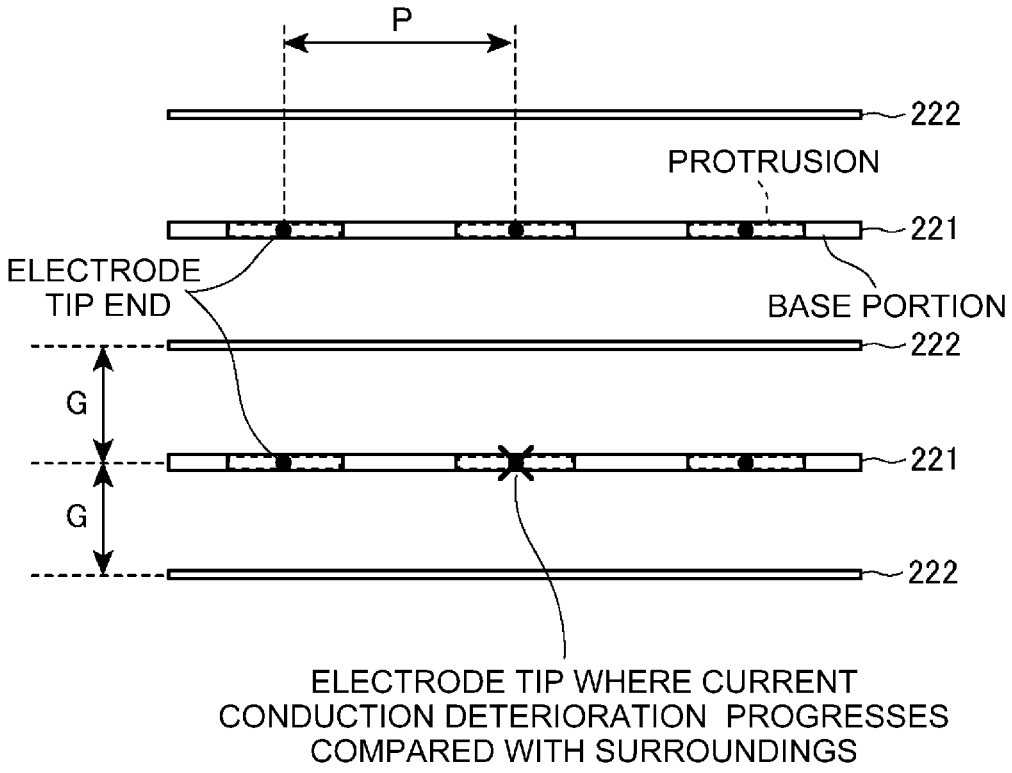
FIG. 5 is a partially enlarged front view of an electrode which illustrates an influence on collection efficiency due to current conduction deterioration of the discharging electrode.

The discharging electrode including the above-described protrusions includes a plurality of the protrusions through the flat plate-shaped base portion. Accordingly, when a protrusion in which a current conduction deterioration further proceeds in comparison to the periphery occurs, a current conduction amount to the portion decreases, resulting in a partially unstable corona formation of a section of the discharging electrode (refer to FIG. 5). The opening of the charging unit is partitioned by the flat plate-shaped counter electrode, which may result in insufficient charging with respect to the floating fine particles passing through the section that includes a protrusion in which the current conduction deterioration proceeds, causing a deterioration of dust collection efficiency.

In some examples, the radius of curvature of the tip end of the discharging electrode is set to be greater than the average diameter of the developer, and thus the electrostatic adhesion of the developer and the like to the tip end may be mitigated. In addition, when the radius of curvature of the tip end of the discharging electrode is set to a range from two times the average diameter of the developer to approximately half of the thickness of the constituent material of the protrusion, a deviation of the application voltage associated with corona formation may be suppressed, and an influence on the charging process to the floating fine particles may be minimized.

In some examples, the radius of curvature of the tip end of the discharging electrode 221 can be determined by measuring a tip end of a contour portion of a projected image that is obtained on the counter electrode 222 and has an actual size of the discharging electrode 221 when the discharging electrode 221 is provided in the charging unit 220. A method or apparatus of measurement of the shape of the tip end may include a contact type or non-contact type surface shape measurement device, a shape measurement laser microscope, and the like. Surface shape information that is obtained may be analyzed by an analysis tool associated with the above-described devices, or can be geometrically determined in a figure by using a computer aided design (CAD). In addition, the average diameter of the developer can be determined by an average particle size that is calculated from a volume-basis particle size frequency and accumulation distribution that is measured by an electrical detection band method (Coulter principle). For example, the average diameter can be measured by a precise particle size distribution measuring device (Multisizer 3 or Multisizer 4*e*) manufactured by Beckman Coulter.

In some examples, the high voltage applied to the discharging electrode has a polarity opposite to a charging polarity of a developer, and is controlled by a "constant current control method" of increasing or decreasing the application voltage so that the inter-electrode current conduction amount becomes a predetermined amount. Accordingly, an unintended emission of ozone or current conduction deterioration of the electrode may be suppressed.

When the high voltage applied to the discharging electrode 221 is set to a polarity opposite to the charging polarity of a developer, it can be used also as a high-voltage application device used in the transfer unit inside the image forming apparatus to help minimize the size of the image forming apparatus.

The charging polarity of the developer can be determined when measuring a charging amount of toner images of respective colors developed on the photosensitive drums 112 by, for example, a suction type small-sized charging amount measuring device (Model 212HS) manufactured by Trek Japan Corporation, and the like.

The dust collection unit 240 may include a tubular ventilation passage that is formed by stacking polymer sheets which are subjected to an electret treatment, and thus a surface of the tubular ventilation passage may be semi-permanently charged. As a result, the floating fine particles which are charged by the charging unit 220 may be electrostatically collected. In the electret treatment, a heated and melted polymer material or an intermediate body of a polymer material is solidified while applying a high voltage thereto in order for the polymer material to have a charged structure. Accordingly, the polymer material enters a semi-permanently charged state.

When the polymer sheet is subjected to the electret treatment, or the structure including the tubular ventilation passage is humidified with a water vapor transpired from a humidifier, the polymer sheet or the structure returns to a charged state after being dried under an air flow. When the polymer sheet or the structure is immersed in a poorly soluble organic solvent such as isopropyl alcohol, a charging retaining structure constructed in the polymer material can be changed, which may affect the validity of the electret treatment.

A charged state of the polymer sheet that is subjected to the electret treatment can be checked by, for example, an electrostatic analyzer (FMX-004) manufactured by Simco-Ion, Kelvin probe force microscope (Dimension Edge) manufactured by Bruker, or the like.

Figure 6A:
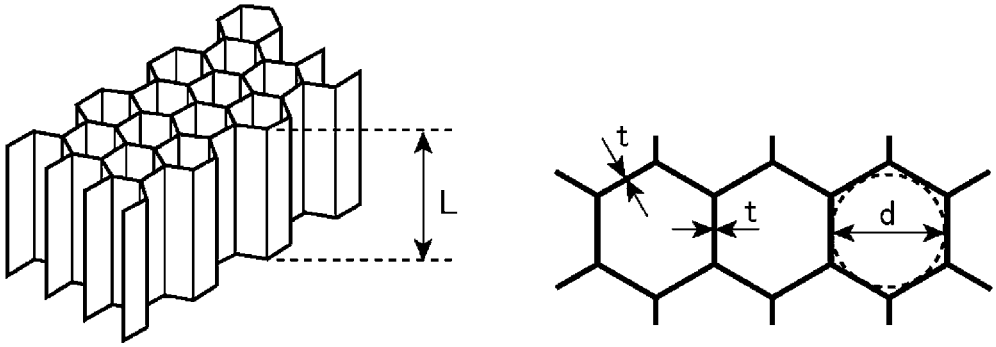
FIG. 6(*a*) is an isometric view illustrating an example honeycomb structure having a tubular ventilation passage and a cross-sectional view of the honeycomb structure, and FIG. 6(*b*) is an isometric view illustrating an example corrugate structure having a tubular ventilation passage and a cross-sectional view of the corrugate structure.
Figure 6B:
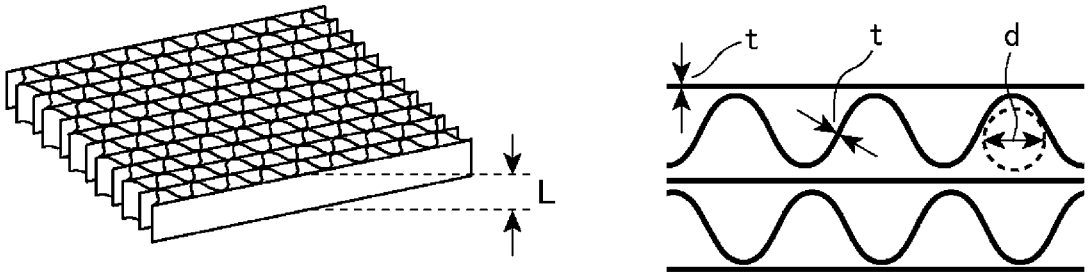

A honeycomb structure and a corrugate structure illustrated in FIG. 6, and the like can be used as a structure including the tubular ventilation passage in the dust collection unit 240. Accordingly, an air flow that occurs due to suction of the air flow generation unit 210 is uniformly distributed and is rectified by the structure including the tubular ventilation passage when charging the floating fine particles in the charging unit 220. When current conduction deterioration of the discharging electrode occurs, an influence on floating fine particle collection efficiency may nevertheless be minimized. In addition, since the polymer sheet that is subjected to the electret treatment is used, the floating fine particles may be electrostatically collected in the air flow with a less complex configuration in comparison to a two-stage type electrostatic collection device in which a high voltage is applied to both the charging unit and the collection unit.

A length L (mm) of a ventilation passage of the structure including the tubular ventilation passage is set to satisfy a relationship of $L>d$ with respect to an opening diameter d (mm). In the case of a relationship of $L\leq d$, the floating fine particles in the air diffuses into the tubular ventilation passage, and are less likely to be electrostatically adsorbed, which may affect the collection efficiency.

In addition, the opening diameter d of the tubular ventilation passage is selected and combined so as to satisfy relationships of $d/G=0.05$ to 1.0 and $d\times G<20$ with respect to the gap G between the discharging electrode 221 and the flat plate-shaped counter electrode 222. In a case where d/G is less than approximately 0.05, the number of tubular ventilation passages with respect to a space partitioned by the flat plate-shaped counter electrode increases, and thus an influence due to current conduction deterioration of the discharging electrode 221 may occur. In contrast, in a case where d/G is greater than approximately 1.0, the number of the tubular ventilation passages with respect to the space partitioned by the flat plate-shaped counter electrode decreases, which may affect the collection efficient. In addition, in a case where $d\times G$ is greater than approximately 20, the number of the tubular ventilation passages per unit length and the number of partitions of the counter electrode decrease in the same time, which may also effect collection capability. In some examples, a relationship of the opening diameter d of the tubular ventilation passage, and the gap G between the discharging electrode 221 and the flat plate-shaped counter electrode 222 may be maintained at one or more predetermined values or within one or more predetermined ranges.

In some examples, the opening diameter d of the structure including the tubular ventilation passage is approximately 0.5 to 2 mm. In a case where the opening diameter d is less than approximately 0.5 mm, a pressure loss increases which may affect the ability to increase the air throughput. In addition, in a case where the opening diameter d is greater than approximately 2 mm, collection efficiency decreases.

The honeycomb structure including the tubular ventilation passage can be manufactured by a method in which an adhesive is linearly applied to both surfaces of the polymer sheet that is subjected to the electret treatment, and a plurality of the polymer sheets are stacked on each other into a block shape. The polymer sheet having a block shape is cut in a direction perpendicular to an adhesive application direction, and is spread in an upper and lower direction to obtain the honeycomb structure. At this time, an arbitrary opening diameter d can be obtained by changing an application width and an application interval of the adhesive that is linearly applied, and by changing the degree of spreading. On the other hand, in a case of manufacturing the corrugate structure, the corrugate structure can be manufactured by using corrugator. A polymer sheet that is subjected to the electret treatment is shaped into a corrugate shape, and a top portion thereof is attached to an additionally prepared polymer sheet that is subjected to the electret treatment, thereby obtaining a single-faced cardboard shape. A plurality of the single-faced cardboards are stacked and joined, and the resultant stacked body is cut to prepare the corrugate structure. At this time, when shaping the polymer sheet into the corrugate shape, a shape or shaping conditions are adjusted to obtain an arbitrary opening diameter d. Furthermore, in any case, the adhesion of the polymer sheet may be accomplished by thermal welding. In addition, the electret treatment can be performed immediately before the adhesion process.

Examples of a material for performing the electret treatment include a thermoplastic resin (an acrylic resin, a polyethylene resin, an ABS resin, and the like) and a thermosetting resin (a polyester resin, an epoxy resin, and the like) through which electricity is less likely to conduct. However, the dust collection unit 240 may be susceptible to the water vapor that is supplied to the charging unit 220. Accordingly, as a polymer material used in the polymer sheet that forms the structure including the tubular ventilation passage, a polymer material having low affinity to water may be selected so as not to decrease the effect of the electret treatment. Even though water particles may adhere to a surface of a polymer sheet having a contact angle with respect to water that is 80° or greater, the polymer sheet can rapidly return to an original state through ventilation. Examples of the polymer material include polypropylene, polyethylene, polyvinylidene fluoride, a fluorinated resin, a silicon resin, and the like, and these may be used alone or in combination. In addition, a void may be formed in the polymer material or the polymer material which contains a charging control agent so as to raise a charging retention amount. For example, the charging control agent can be appropriately selected from negative charge type charging control agents including a metal compound of a carboxylic acid such as salicylic acid, naphthoic acid, and dicarboxylic acid; a polymer type compound having a sulfonic acid group or a carboxylic acid group in a side chain thereof; a boron compound; a urea compound; a silicon compound; and calixarene, or positive charge type charging control agents including a quaternary ammonium salt; a polymer type compound having the quaternary ammonium salt in a side chain thereof; a guanidine compound; an imidazole compound; and azine compound, or any combination thereof.

The contact angle of the polymer sheet can be obtained as follows. In a state in which pure water is slowly added dropwise to a surface of the polymer sheet to form a droplet thereon, and the droplet of the pure water approximately stops on the surface of the polymer sheet, an angle between the polymer sheet and the droplet of the pure water is measured to obtain the contact angle. For example, the measurement can be performed by using a contact angle meter (DMo-501) manufactured by Kyowa Interface Science Co., Ltd, and the like.

The thickness t of the polymer sheet that constitutes the ventilation passage of the structure including the tubular ventilation passage may be approximately 0.05 to 1.5 mm. A thickness t of less than approximately 0.05 mm may affect the ability to perform the electret treatment, and a thickness t of greater than 1.5 mm may cause a decrease in a ratio of an opening portion of the tubular ventilation passage which occupies the wind receiving surface, which may lower the collection capability.

In some examples, the length L of the ventilation passage of the structure including the tubular ventilation passage is approximately 3 mm or greater to maintain stable collection efficiency. In other examples, the tubular ventilation passage is approximately 5 to 30 mm. In a case where the length L is less than approximately 5 mm, the operational lifespan of the dust collection unit 240 may be shortened, and a replacement frequency increases. In addition, in a case where the length L is greater than approximately 30 mm, the water vapor supplied by the humidification device 231 may be cooled down and condensed.

However, in an intermediate and high-speed type image forming apparatus in which a main body volume is greater than approximately 250 liters, a length L of the ventilation passage may be set to satisfy a relationship of U1000 V≥0.005 with respect to a ventilation speed V (m/second) of air that is introduced to the structure including the tubular ventilation passage, to treat an air throughput for withstanding a heat exhaust design of the main body of the image forming apparatus. For example, in a case of an intermediate and high-speed type image forming apparatus in which the main body volume is approximately 350 liters, air exhaust corresponding to approximately ⅓ to 1 ventilation for one minute with respect to the main body volume may be used, which may increase a size of the dust collection device. On the other hand, in some example electric dust collection units 200, an area of the wind receiving surface of the dust collection unit 240 may be set to approximately 100 $cm^2$, which contributes to a reduction in size of the image forming apparatus.

In some examples, the opening diameter d of the tubular ventilation passage or the thickness t of the polymer sheet that forms the structure including the tubular ventilation passage can be determined by photographing an enlarged photograph of a vertical cross-section of the tubular ventilation passage (refer to FIG. 6). For example, opening diameters and thicknesses of randomly extracted 20 sites or greater may be obtained by a method in which the enlarged photograph of the vertical cross-section of the tubular ventilation passage is received by a PC and the like, and the opening diameters and the thicknesses are measured by using image measurement software. Additionally, a method may be used in which the enlarged photograph is printed out and the opening diameters and the thicknesses are directly measured by using a measuring device, and then the opening diameters and the thicknesses are respectively averaged to determine the opening diameter d and the thickness t. Furthermore, the opening diameter of the tubular ventilation passage may be defined as a diameter of a circle inscribed in an inner wall of the tubular ventilation passage.

In addition, the ventilation speed V of air that is introduced to the structure including the tubular ventilation passage may be determined by a surface wind speed of the wind receiving surface, and can be measured by, for example, a portable anemometer (Crimomaster model 6501-00, probe; 6543-21) manufactured by Kanomax Japan Inc., and the like.

The electric dust collection unit 200 includes the water vapor generation unit 230 that supplies a water vapor to the charging unit 220, and the water vapor is supplied to the charging unit 220. Accordingly, current conduction deterioration of the discharging electrode and the amount of ozone generated may be suppressed. A high voltage having a positive polarity may be applied to the discharging electrode to decrease the amount of ozone generated.

Figure 7:
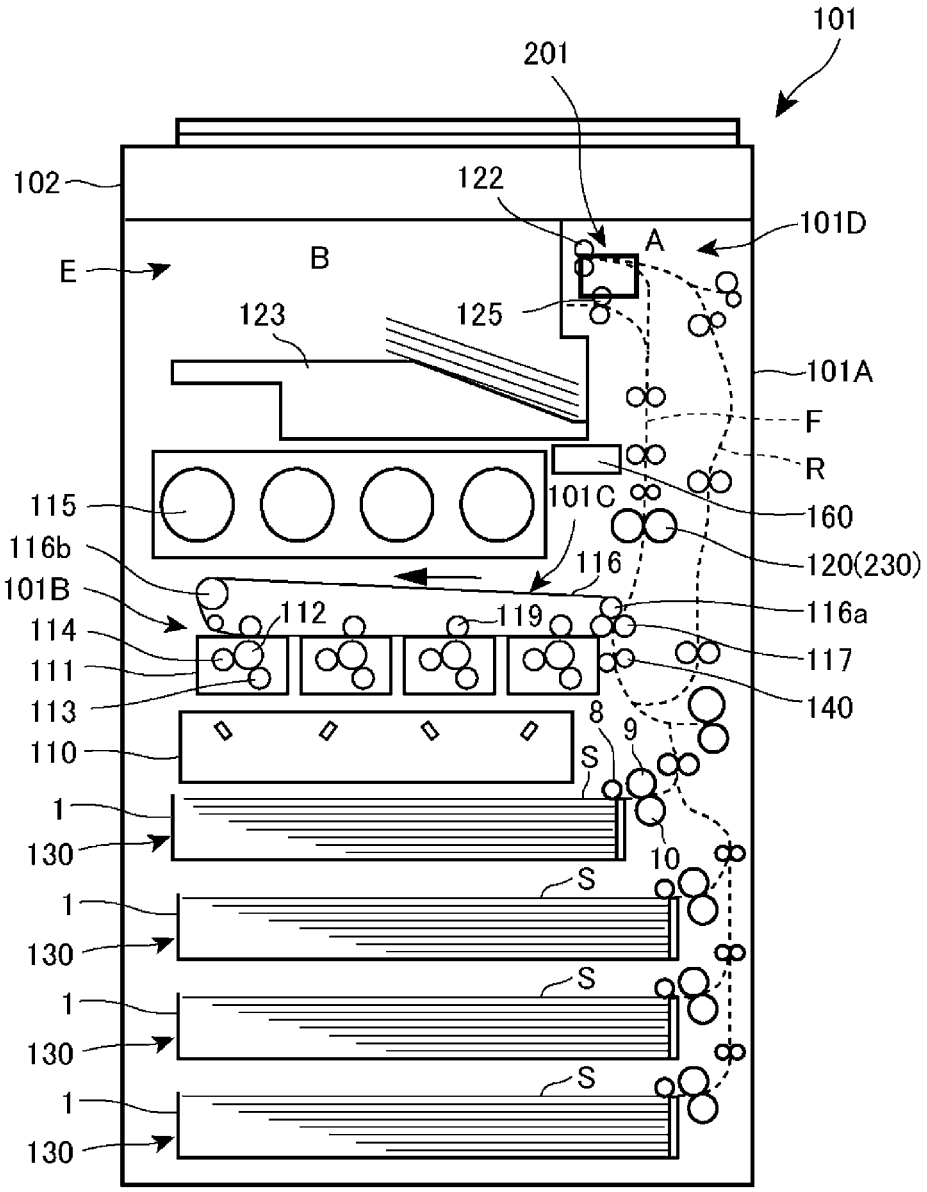
FIG. 7 is a schematic view illustrating another example image forming.
Figure 8:
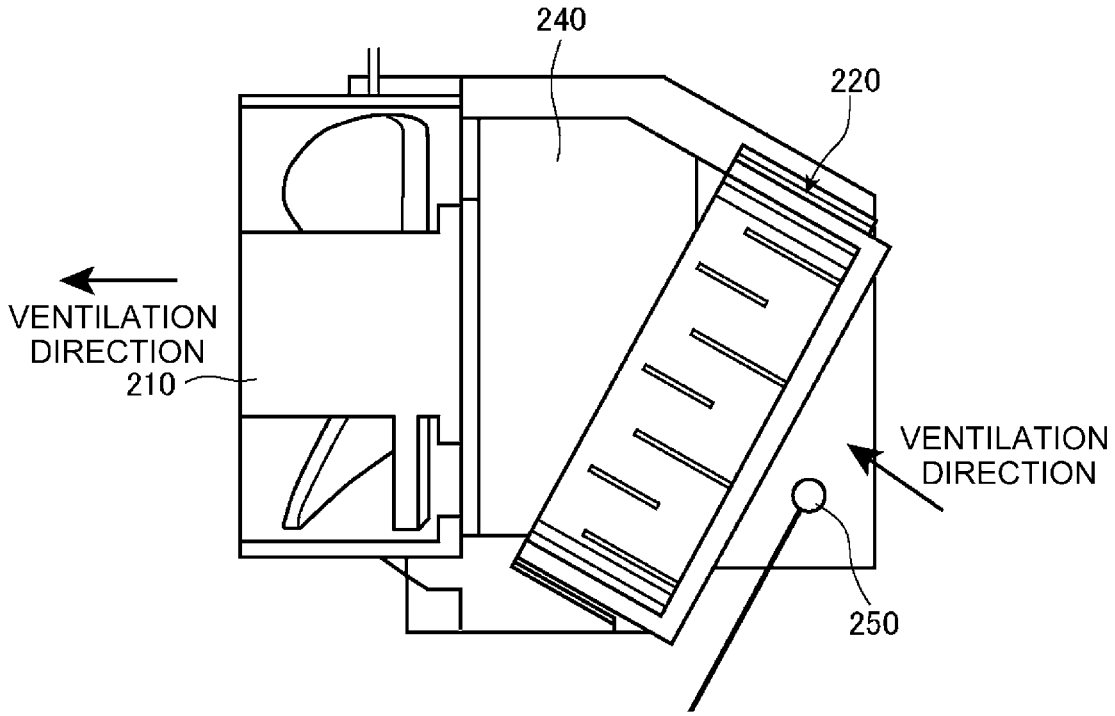
FIG. 8 is a cross-sectional view of a main body portion of an example electric dust collection system including an inclined counter electrode.

The humidification device 231 associated with the water vapor generation unit 230 may include, for example, small-sized humidifiers of a steam type, an ultrasonic type, a vaporizing type (heater-less type), and a hybrid type. In some examples, the image forming apparatus may include an electrophotographic image forming apparatus, and a heating and pressing fixing device may be disposed inside the image forming apparatus as the water vapor generation unit 230 (refer to FIG. 7). In this case, moisture contained in the transfer material is transpired by the fixing unit 120, and a water vapor is supplied to the charging unit 220 through the paper ejection route F. Accordingly, a water feeding may be omitted, and thus both the humidification device 231 and the water feeding tank 232 may be omitted. When a direction of the flat plate-shaped counter electrode 222 disposed in the charging unit 220 is inclined to a direction of the paper ejection route F that is continuous to the fixing unit 120, a water vapor may be supplied from the fixing unit 120 to the charging unit 220 (refer to FIG. 8). As a result, the floating fine particles which occur at the periphery of the fixing unit 120 may be guided to the main body portion 201.

In some examples, a supply rate of the water vapor that is supplied from the water vapor generation unit 230 to the charging unit 220 is approximately 0.20 to 0.50 mg/minute per 1 $cm^2$ of cross-sectional area of a wind path that passes through an electrode portion of the charging unit. In a case where the supply rate of the water vapor is less than approximately 0.20 mg, a supply effect of the water vapor may not be sufficient, and in a case where the supply rate is greater than approximately 0.50 mg/minute, a deterioration of collection efficiency may occur due to over-humidity of the dust collection unit 240.

In some examples, the supply rate of the water vapor is defined as a value that is obtained by dividing a transpiration amount of water put into a humidification device by an operation time of the humidification device. In addition, in a case where the fixing device also functions as the humidification device, a value obtained by dividing a water content of a transfer material by a printing time may be set as the supply rate of the water vapor. Furthermore, the water content of the transfer material, which may be reduced when the transfer material passes through the fixing device, is calculated in advance from a water content of a not-used transfer material and a water content of the transfer material immediately after passing through the fixing device in a no-image state (solid white). Furthermore, the water content of the transfer material can be measured, for example, by using a resistance-type paper moisture meter (HK-300) manufactured by Kett Electric Laboratory, and the like.

In a case where the fixing device is used as the humidification device, a humidification speed can be adjusted with a heating temperature of the fixing device, and the humidification speed can be raised by raising the heating temperature. For example, a temperature and humidity sensor is mounted in an upstream portion of the air flow that is introduced to the charging unit 220 in advance, and an absolute moisture amount is calculated from measurement values of the temperature and humidity sensor and is fed back to a heating control unit of the fixing device and a control unit of the air flow generation unit 210. Accordingly, the supply rate of the water vapor that is supplied to the charging unit 220 may be automatically adjusted regardless of the kind or the water content of the transfer material.

Example Image Forming Apparatuses

An external appearance of MultiXpress X7600LX (manufactured by Samsung Electronics Co., Ltd., main body volume: 346 liters) that is a color multifunctional machine using an electrophotographic method was left as-is, and a printout speed was changed from 60 sheets/minute to 70 sheets/minute. A photosensitive drum was changed to a high-sensitivity photosensitive drum along with the changing of the printout speed. In addition, adjustment of an input voltage to the charging roller used as a charging unit of the photosensitive drum, and the like are performed. According to this, a modified test machine with high productivity (hereinafter, referred to simply as "modified test machine") was prepared. Furthermore, as a developer, a negative charge type color toner having an average particle size of 5.5 μm was used.

A graphic image with an image ratio of 35% (e.g., 35% of the printable area of the paper) was continuously printed for 10 minutes to evaluate a dissipation rate of floating fine particles and ozone which are dissipated from the modified test machine (hereinafter, simply referred to as "dissipation amount test"). The dissipation amount of the floating fine particles per 10 minutes was $12\times10^{11}$ pieces, and the dissipation rate of ozone was less than 1.0 mg/hour.

Next, the electric dust collection unit 200 was mounted on the modified test machine. As a mounting position, a space between the paper ejection route F and the reverse route R of the transfer material was used (refer to FIG. 1), and the main body portion 201 was provided in a space ranging from an upper right side of the ejection roller pair 125 to a rear side of the reversing roller pair 122. At this time, an existing axial flow blower for exhaust (50 mm×50 mm, four blowers) was used as-is as the air flow generation unit 210, and the main body portion 201 was disposed on a suction side of the axial flow blower for exhaust to generate an air flow with a small wind speed distribution to the main body portion 201. Furthermore, a total exhaust amount from the axial flow blower for exhaust was 0.42 $m^3$/minute, and an average exhaust wind speed per blower was 0.7 m/second. A small-sized ultrasonic humidifier was used as the humidification device 231 of the water vapor generation unit 230. In addition, a high-voltage power supply unit was used as the power supply to the charging unit 220 in the image forming apparatus, and modifications were made so that a current conduction amount between the discharging electrode and the counter electrode could be controlled by an application voltage. As a result, in the modified test machine on which the electric dust collection unit 200 was mounted, an external appearance was not changed, and an example electric dust collection unit could be mounted thereon.

Example 1

In the charging unit 220, a flat plate-shaped counter electrode was disposed in parallel to both lateral surfaces of the serrated shaped discharging electrode. A size of the opening of the charging unit 220 was set to 40 mm (vertical) and 250 mm (horizontal), the gap G between the discharging electrode and the counter electrode was set to 3.5 mm, and the opening was partitioned by six sheets of the counter electrodes (and five sheets of the discharging electrodes). The discharging electrode was obtained by etching a flat plate manufactured by SUS having a plate thickness of 0.3 mm, and the interval P of serrated shaped protrusions was set to 3.5 mm, and the radius of curvature R of the electrode tip end was set to 50 μm.

A corrugate structure obtained by stacking a polypropylene sheet (thickness t: 0.1 mm, and contact angle: 94°) subjected to the electret treatment was used as the dust collection unit 240. An opening diameter d of tubular ventilation passages of the corrugate structure was set to 0.9 mm, a length L thereof was set to 20 mm, and an area of the wind receiving surface was set to 100 $cm^2$ (L/1000 V=0.029).

The electric dust collection unit 200 was set so that a positive-polarity voltage was applied to the discharging electrode in combination with initiation of a print operation, and the inter-electrode current conduction amount became 90 μA. In addition, the supply rate of the water vapor supplied from the water vapor generation unit 230 to the charging unit 220 was adjusted to be 0.30 mg/minute per 1 $cm^2$ of cross-sectional area of the wind path that passes through the electrode portion of the charging unit 220.

The dissipation amount test was performed under the above-described setting conditions. The dissipation amount of the floating fine particles per 10 minutes was $0.8\times10^{11}$ pieces, and the dissipation rate of ozone was less than 1.0 mg/hour. When the electric dust collection unit 200 was mounted, and an operation was performed under the setting conditions, the dissipation amount of ozone did not increase, and the dissipation amount of the floating fine particles could be reduced.

In addition, a text image with an image ratio of 10% (e.g., 10% of the printable area of the paper) was continuously printed for 100 hours, and the dissipation test was repeated again. As a result, the dissipation amount of the floating fine particles was $9.5\times10^{10}$, and the dissipation rate of ozone was less than 1.0 mg/hour. From the results, it could be understood that a satisfactory state was maintained.

Details of the above-described results are collected in a table of FIG. 10. Furthermore, an example measurement method and an evaluation reference of an example measurement result with respect to an evaluation item of the dissipation test are as follows.

Evaluation of Dissipation Amount of Floating Fine Particles

With regard to the dissipation amount of the floating fine particles dissipated to the outside of the image forming apparatus, a variation of the number of the floating fine particles dissipated in printing by the image forming apparatus provided in a clean booth was measured, and the number of particles dissipated for 10 minutes was calculated in conformity to a method described in an annex S-M of RAL-UZ171 of Germany. The calculated dissipation amount of the floating fine particles was evaluated on the basis of the following reference. Furthermore, in measurement of the variation of the number of the floating fine particles, a small-sized UFP measurement device (NANOSCAN SMPS NANOPARTICLE SIZER Model 3910, manufactured by TSI Inc.) was used.

A: Less than 1.0×10^11 pieces (very satisfactory)

B: Equal to or greater than 1.0×10^11 pieces and less than 2.0×10^11 pieces (satisfactory)

C: Equal to or greater than 2.0×10^11 pieces and less than 3.0×10^11 pieces (acceptable)

D: 3.0×10^11 pieces or greater (non-compliant)

Evaluation of Dissipation Rate of Ozone

With regard to the dissipation amount of ozone discharged to the outside of the image forming apparatus, the dissipation rate was calculated in the same manner as described above in "Evaluation of Dissipation Amount of Floating Fine Particles". The evaluation was performed on the basis of the following reference. Furthermore, in measurement of the concentration of ozone dissipated during printing, an ultraviolet absorption type ozone densitometer for low concentration (Model 1100, manufactured by Dylec Inc.) was used.

A: Less than 1.0 mg/hour (very satisfactory)

B: Equal to or greater than 1.0 mg/hour and less than 2.0 mg/hour (satisfactory)

C: Equal to or greater than 2.0 and less than 3.0 mg/hour (acceptable)

D: 3.0 mg/hour or greater (non-compliant)

Example 2

The gap G between the discharging electrode and the counter electrode was set to 5.0 mm, and the opening was partitioned by four sheets of counter electrodes (and three sheets of discharging electrodes). The interval P of the serrated shaped protrusions of the discharging electrode was changed to 5.0 mm. In addition, a honeycomb structure obtained by stacking a polypropylene sheet subjected to the electret treatment was used as the dust collection unit 240. An opening diameter d of tubular ventilation passages of the honeycomb structure was set to 0.9 mm, and a length L thereof was set to 10 mm. In addition, the settings were made in the same manner as in Example 1 except for adjustments in which a positive-polarity voltage was applied to the discharging electrode and the inter-electrode current conduction amount became 120 μA, and then the dissipation amount test was performed.

As a result, although the inter-electrode current conduction amount was further increased in correspondence with a decrease in the length L of the tubular ventilation passages of the honeycomb structure in comparison to Example 1, the charging unit 220 was supplied with the water vapor, and thus the dissipation amount of ozone slightly increased.

Example 3

The gap G between the discharging electrode and the counter electrode was set to 2.5 mm, and the opening was partitioned by seven sheets of counter electrodes (and six sheets of discharging electrodes). With regard to the serrated shaped protrusions of the discharging electrode, the radius of curvature R of the tip end was changed to 125 μm, and the interval P of the protrusions was changed to 2.5 mm. In addition, a honeycomb structure obtained by stacking a polypropylene sheet (thickness t=0.05 mm) subjected to the electret treatment was used as the dust collection unit 240. An opening diameter d of tubular ventilation passages of the honeycomb structure was set to 0.5 mm, and a length L thereof was set to 5 mm. In addition, the settings were made in the same manner as in Example 1 except for adjustments in which a positive-polarity voltage was applied to the discharging electrode and the inter-electrode current conduction amount became 180 μA, and then the dissipation amount test was performed.

As a result, the gap G between the electrodes was narrowed, and thus an exhaust wind amount decreased due to an influence by the electrode thickness that occupied the opening of the charging device, but the decrease could be adjusted by the axial flow blower for exhaust which was used in the air flow generation unit 210. In addition, in comparison to Example 2, the inter-electrode current conduction amount was further increased in correspondence with the further decrease in the length L of the tubular ventilation passages of the honeycomb structure, and thus the dissipation amount of ozone increased. However, the charging unit 220 was supplied with the water vapor, and thus the dissipation amount of ozone was in an acceptable level. However, since the gap G between the electrodes, and the interval P of the protrusions of the discharging electrode was 2.5 mm, it was less likely to be susceptible to the current conduction deterioration, and a noticeable variation did not occur in the dissipation amount of the floating fine particles or ozone even after continuous printing.

Example 4

The gap G between the discharging electrode and the counter electrode was set to 12.5 mm, and the opening was partitioned by two sheets of counter electrodes (and one sheet of discharging electrode). The protrusions of the discharging electrode were set to have a needle shape in which the radius of curvature R of the tip end was 7.0 μm, and the interval P between the protrusions was changed to 12.5 mm. In addition, a corrugate structure obtained by stacking a polypropylene sheet (thickness t=0.75 mm) subjected to the electret treatment was used as the dust collection unit 240. An opening diameter d of tubular ventilation passages of the corrugate structure was set to 1.5 mm, and a length L thereof was set to 30 mm. In addition, the settings were made in the same manner as in Example 1 except for adjustments in which a positive-polarity voltage was applied to the discharging electrode and the inter-electrode current conduction amount became 60 μA, and then the dissipation amount test was performed.

As a result, since d×G was 19, the number of the tubular ventilation passages per unit length and the number of sections of the counter electrode were smaller. However, the length L was lengthened, and thus the dissipation amounts of the floating fine particles and ozone were compatible with each other in a very satisfactory level. On the other hand, since the radius of curvature R of the tip end of the protrusions was as smaller as 7.0 μm, and the distance G between the electrodes was as wide as 12.5 mm, these were conditions which were susceptible to the current conduction deterioration. However, when the inter-electrode current conduction amount after continuous printing was changed to 200 μm, the dissipation amounts of the floating fine particles and ozone were compatible with each other in an acceptable level.

Example 5

The gap G between the discharging electrode and the counter electrode was set to 2.5 mm, and the opening was partitioned by seven sheets of counter electrodes (and six sheets of discharging electrodes). With regard to the serrated shaped protrusions of the discharging electrode, the radius of curvature R of the tip end was changed to 125 μm, and the interval P of the protrusions was changed to 2.5 mm. In addition, a honeycomb structure obtained by stacking a polypropylene sheet (thickness t=1.5 mm) subjected to the electret treatment was used as the dust collection unit 240. An opening diameter d of tubular ventilation passages of the honeycomb structure was set to 2.5 mm, and a length L thereof was set to 10 mm. In addition, the settings were made in the same manner as in Example 1 except for an adjustment in which a positive-polarity voltage was applied to the discharging electrode and the inter-electrode current conduction amount became 180 μA, and then the dissipation amount test was performed.

As a result, since d/G was 1.0, the number of the tubular ventilation passages with respect to the space partitioned by the counter electrode was small. However, when the length L was lengthened, the dissipation amount of the floating fine particles could be set to an acceptable level as in Example 3. In addition, since the plate thickness of the discharging electrode was 0.3 mm, and the radius of curvature R of the tip end of the protrusions was 125 μm, the dissipation amount of ozone tended to increase, but the charging unit was supplied with the water vapor, and thus dissipation of ozone could be suppressed. In addition, when the inter-electrode current conduction amount after continuous printing was changed to 200 μA, the dissipation amount of the floating fine particle or ozone could be maintained in an acceptable level.

Example 6

The gap G between the discharging electrode and the counter electrode was set to 10 mm, and the opening was partitioned by three sheets of counter electrodes (and two sheets of discharging electrodes). The protrusions of the discharging electrode were set to have a needle shape in which the radius of curvature R of the tip end was 7.0 μm, and the interval P between the protrusions was changed to 10 mm. In addition, a honeycomb structure obtained by stacking a polypropylene sheet (thickness t=0.05 mm) subjected to the electret treatment was used as the dust collection unit 240. An opening diameter d of tubular ventilation passages of the honeycomb structure was set to 0.5 mm, and a length L thereof was set to 10 mm. In addition, the settings were made in the same manner as in Example 1 except for adjustments in which a positive-polarity voltage was applied to the discharging electrode and the inter-electrode current conduction amount became 60 μA, and then the dissipation amount test was performed.

As a result, since d/G was 0.05, and the number of the tubular ventilation passages with respect to the space partitioned by the counter electrodes was large, even in a small inter-electrode current conduction amount, the dissipation amount of the floating fine particles could be set to an acceptable level as in Examples 3. On the other hand, since the radius of curvature R of the tip end of the protrusions was 7.0 μm, and the distance G between the electrodes was 10 mm, an influence of the current conduction deterioration was an issue. However, when the inter-electrode current conduction amount after continuous printing was changed to 200 μA, the dissipation amounts of the floating fine particles and ozone were compatible with each other in an acceptable level.

Example 7

The settings were made in the same manner as in Example 2 except that the radius of curvature R of the tip end of the protrusions of the discharging electrode was set to 20 μm, and then the dissipation amount test was performed.

The radius of curvature R of the tip end of the protrusions of the discharging electrode was 20 μm, and thus it was susceptible to the current conduction deterioration. However, in the dissipation amount test after continuous printing, the dissipation amounts of the floating fine particles and ozone were in an acceptable level.

Example 8

The radius of curvature R of tip end of the protrusions of the discharging electrode was changed to 50 μm, and a corrugate structure obtained by stacking polyethyleneterephthalate sheet (thickness t=0.1 mm, and contact angle=79°) subjected to the electret treatment was used as the dust collection unit 240. An opening diameter d of tubular ventilation passages of the corrugate structure was set to 0.9 mm, and a length L thereof was set to 10 mm. In addition, the settings were made in the same manner as in Example 2 except for adjustments in which a positive-polarity voltage was applied to the discharging electrode and the inter-electrode current conduction amount became 60 μA, and then the dissipation amount test was performed.

As a result, the dissipation amount of the floating fine particles increased by an increase of hydrophilicity of the corrugate structure. However, the dissipation amount of the floating fine particles could be set to an acceptable level while suppressing the dissipation amount of ozone. In addition, in the dissipation amount test after continuous printing, the inter-electrode current conduction amount was changed to 150 μA, and thus the dissipation amount of the floating fine particles was improved while suppressing the dissipation amount of ozone in an acceptable level. That is, it was confirmed that supplying the charging unit 220 with the water vapor causes a widening of an inter-electrode current conduction amount control range, in which the dissipation amounts of the floating fine particles and ozone are compatible with each other in an acceptable level.

Example 9

A honeycomb structure obtained by stacking a polyethylene sheet (thickness t=0.1 mm, contact angle=101°) subjected to the electret treatment was used as the dust collection unit 240. An opening diameter d of tubular ventilation passages of the honeycomb structure was set to 0.9 mm, and a length L thereof was set to 10 mm. In addition, the settings were made in the same manner as in Example 2 except for adjustments in which a positive-polarity voltage was applied to the discharging electrode and the inter-electrode current conduction amount became 200 μA, and the supply rate of the water vapor supplied from the water vapor generation unit 230 to the charging unit 220 was set to 0.50 mg/minute per 1 $cm^2$ of cross-sectional area of the wind path that passes through the electrode portion of the charging unit 220, and then the dissipation amount test was performed.

Although the supply rate of the water vapor was 0.50 mg/minute, and the inter-electrode current conduction amount was raised and the polyethylene honeycomb structure with low hydrophilicity was used as the dust collection unit 240, the dissipation amount of the floating fine particles was greatly reduced while suppressing the dissipation amount of ozone in a satisfactory level. In addition, even in the dissipation amount test after continuous printing, deterioration of floating fine particle collection capability was small, and the collection capability could be maintained in a satisfactory level.

Example 10

The settings were made in the same manner as in Example 2 except that modifications were made so that a positive-polarity voltage was applied to the discharging electrode of the charging unit 220 and the inter-electrode current conduction amount became 40 μA. Additionally, the supply rate of the water vapor supplied from the water vapor generation unit 230 to the charging unit 220 was set to 0.20 mg/minute per 1 $cm^2$ of cross-sectional area of the wind path that passes through the electrode portion of the charging unit 220, and then the dissipation amount test was performed.

As a result, a control range of the inter-electrode current conduction amount was limited to a low current side, but the dissipation amounts of the floating fine particles and ozone were compatible with each other in an acceptable level. In addition, even in the dissipation amount test after continuous printing, the dissipation amounts of the floating fine particles and ozone could be maintained in an acceptable level.

Example 11

The water vapor generation unit 230 was removed, and the fixing unit 120 was used as the humidification device. In addition, the charging unit 220 was disposed in an inclined manner so that a direction of the flat plate-shaped counter electrode 222 disposed in the charging unit 220 became parallel to a ventilation direction of an air flow that flows into from the paper ejection route F continuous to the fixing unit 120 (refer to FIG. 7 and FIG. 8). The same corrugate structure used in Example 1 was prepared as the dust collection unit 240. Since a part of the wind receiving surface was cut off in a slanted manner, the length L of tubular ventilation passages was 4 to 20 mm (L/1000 V=0.006 to 0.029). At this time, an area of the wind receiving surface was maintained to 100 $cm^2$.

In addition, the settings were made in the same manner as in Example 1 except that additional modifications were made in such a manner that the temperature and humidity sensor 250 was mounted in an upstream portion of the air flow that was introduced to the charging unit 220, an absolute moisture amount calculated from a temperature and a humidity which were measured was fed back to a heating control unit (not illustrated) of the fixing device. Additionally, the supply rate of the water vapor supplied to the charging unit 220 was set to 0.30 mg/minute per 1 $cm^2$ of cross-sectional area of the wind path that passes through the electrode portion of the charging unit 220 in accordance with rising or lowering of the fixing temperature, and then the dissipation amount test was performed.

The dissipation amount test was performed under the setting conditions. As a result, the dissipation amount of the floating fine particles per 10 minutes was $0.8\times10^{11}$ pieces, and a dissipation rate of ozone was less than 1.0 mg/hour.

In addition, a text image with an image ratio of 10% (e.g., 10% of the printable area of the paper) was continuously printed for 100 hours, and the dissipation test was performed. As a result, the dissipation amount of the floating fine particles was $9.3\times10^{10}$ pieces, and the dissipation rate of ozone was less than 1.0 mg/hour. From the results, it could be understood that a very satisfactory result obtained in Example 1 reappeared.

Results of the dissipation amount test in Examples 2 to 11 are collectively illustrated in the table of FIG. 10.

Comparative Example 1

The dissipation amount test was performed in the same manner as in Example 10 except that the axial flow blower for exhaust, which is the air flow generation unit 210, was moved to be disposed upstream of the charging unit 220 in the ventilation direction. Additionally, adjustments were made so that a positive-polarity voltage was applied to the discharging electrode of the charging unit 220 and the inter-electrode current conduction amount became 60 μA, and supply of the water vapor from the water vapor generation unit 230 was stopped, and then the dissipation amount test was performed. (Furthermore, when continuously performing printing in this state, the amount of water vapor passing through the electrode portion of the charging unit 220 was 0.10 mg/minute to the maximum per 1 $cm^2$ of cross-sectional area of the wind path that passes through the electrode portion of the charging unit 220.)

As a result, since the charging unit 220 was disposed downstream of the air flow generation unit 210 in the ventilation direction, and an air flow supplied from the axial flow blower for exhaust was used, charging to the floating fine particles and a collection state in the honeycomb structure deteriorated. In addition, the dissipation amount of ozone increased due to stoppage of the supply of the water vapor from the water vapor generation unit 230. In addition, after continuous printing during the dissipation test, an influence of the current conduction deterioration occurred. Accordingly, even when increasing the inter-electrode current conduction amount to 200 μA, the collection state of the floating fine particles was not improved, and the amount of ozone generated deteriorated.

Comparative Example 2

The same honeycomb structure used in Example 10 was additionally prepared, was immersed in isopropyl alcohol for a whole day and night, and was dried with wind to invalidate the electret treatment. Then, the honeycomb structure was used as the dust collection unit 240, and the inter-electrode current conduction amount was readjusted to 200 μA. In addition, the dissipation amount test was performed after the settings were made in the same manner as in Example 10 except that the supply of the water vapor from the water vapor generation unit 230 was stopped.

Since the electret treatment of the honeycomb structure used as the dust collection unit 240 was invalidated, and even when increasing the inter-electrode current conduction amount, the amount of ozone generated deteriorated, and the floating fine particles were insufficiently collected. Therefore, continuous printing and the subsequent dissipation amount test were stopped.

Comparative Example 3

The gap G between the discharging electrode and the counter electrode was set to 15 mm, and the opening was partitioned by two sheets of counter electrodes (and one sheet of discharging electrode). With regard to the serrated shaped protrusions of the discharging electrode, the radius of curvature R of the tip end was changed to 15 μm, and the interval P of the protrusions was changed to 15 mm. In addition, a honeycomb structure obtained by stacking a polypropylene sheet (thickness t=0.1 mm) subjected to the electret treatment was used as the dust collection unit 240. An opening diameter d of tubular ventilation passages of the honeycomb structure was set to 0.5 mm, and a length L thereof was set to 10 mm. In addition, the settings were made in the same manner as in Example 10 except for adjustments in which a positive-polarity voltage was applied to the discharging electrode and the inter-electrode current conduction amount became 90 μA and supply of the water vapor from the water vapor generation unit 230 was stopped, and then the dissipation amount test was performed.

As a result, since d/G was 0.03, an influence of the current conduction deterioration of the discharging electrode occurred, and thus even when changing the current conduction amount to 200 μA, the amount of ozone generated deteriorated, and the floating fine particles were insufficiently collected in the dissipation test after continuous printing.

Comparative Example 4

The gap G between the discharging electrode and the counter electrode was set to 2.0 mm, and the opening was partitioned by ten sheets of counter electrodes (and nine sheets of discharging electrodes). The interval P of the serrated shaped protrusions of the discharging electrode was changed to 2.0 mm. In addition, as the dust collection unit 240, a honeycomb structure obtained by stacking a polypropylene sheet (thickness t=0.1 mm) subjected to the electret treatment was used. An opening diameter d of tubular ventilation passages of the honeycomb structure was set to 2.5 mm. In addition, the settings were made in the same manner as in Example 10 except that supply of the water vapor from the water vapor generation unit 230 was stopped, and then the dissipation amount test was performed.

As a result, since d/G was 1.3, and thus even when setting the current conduction amount to 200 μA, the amount of ozone generated deteriorated, the floating fine particles were insufficiently collected. Therefore, continuous printing and the subsequent dissipation amount test were stopped.

Comparative Example 5

The gap G between the discharging electrode and the counter electrode was changed to 15 mm. In addition, a honeycomb structure obtained by stacking a polypropylene sheet (thickness t=0.1 mm) subjected to the electret treatment was used as the dust collection unit 240. An opening diameter d of tubular ventilation passages of the honeycomb structure was set to 1.5 mm, and a length L thereof was set to 3 mm (L/1000 V=0.004). The settings were made in the same manner as in Example 10 except that supply of the water vapor from the water vapor generation unit 230 was stopped, and then the dissipation amount test was performed.

As a result, since d×G was 23, and thus even when setting the current conduction amount to 200 μA, the amount of ozone generated deteriorated, and the floating fine particles were not sufficiently collected. Therefore, continuous printing and the subsequent dissipation amount test were stopped.

Comparative Example 6

Figure 9:
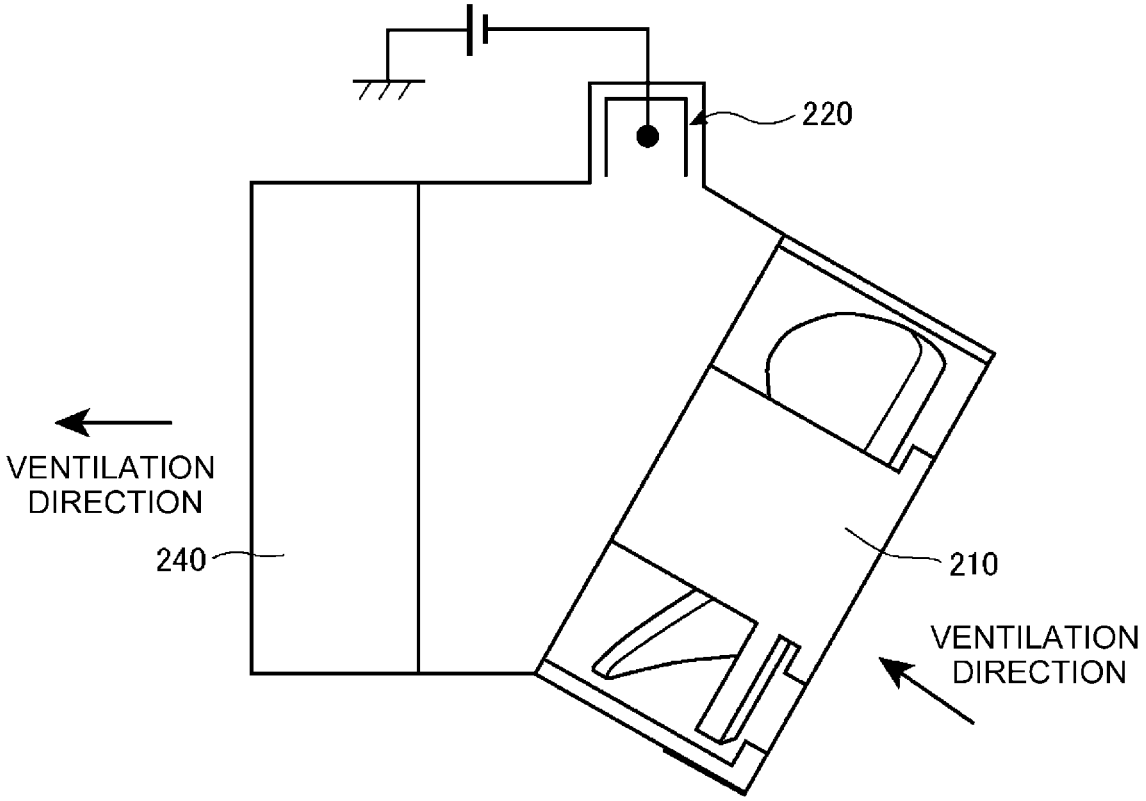
FIG. 9 is a cross-sectional view of the main body portion of an example electric dust collection system including a charging unit.

The axial flow blower for exhaust, which is the air flow generation unit 210, was moved to be disposed upstream of the charging unit 220 in the ventilation direction, and a DC voltage of −10 kV was applied to the charging unit 220 in which a discharging wire (tungsten oxide wire, wire diameter: 100 μm) was used as the discharging electrode (refer to FIG. 9). In addition, the settings were made in the same manner as in Comparative Example 1 except that a pleated HEPA filter was used as the dust collection unit 240, and then the dissipation amount test was performed. Furthermore, an additional high-voltage electric substrate was added for application of a negative-polarity high voltage.

As a result, the HEPA filter was used as the dust collection unit 240 instead of the structure including tubular ventilation passages. Accordingly, an exhaust wind amount that was obtained was approximately 30 liters/minute for one minute. As a result, dissipation of the floating fine particles was suppressed, but the dissipation amount of ozone increased. Next, continuous printing was performed, but an ambient temperature of the modified test machine was higher than 55°, and thus the test stopped. A fan configured to obtain a constant pressure was used to increase the exhaust wind amount.

Results of the dissipation amount test in Comparative Examples 1 to 6 are collectively illustrated in the table of FIG. 10.

The invention claimed is:

1. A particle collection system of an image forming apparatus, comprising:

an air flow generation device to generate an air flow for transporting floating fine particles;

a charging device that is disposed upstream of the air flow generation unit in a ventilation direction to charge the floating fine particles in the air flow; and a particle collection device that is disposed downstream of the charging device in the ventilation direction to collect the floating fine particles which are charged by the charging device, wherein the charging device comprises at least a discharging electrode to which a high voltage is applied by a high-voltage power supply, and a flat plate-shaped counter electrode that is disposed in parallel to two lateral surfaces of the discharging electrode and is to be grounded, wherein the particle collection device comprises a structure comprising a tubular ventilation passage that is formed by polymer sheets, wherein a length of the tubular ventilation passage in the ventilation direction is greater than an opening diameter of the tubular ventilation passage, and wherein the opening diameter of the tubular ventilation passage is less than or equal to a gap between the discharging electrode and the counter electrode.

2. The particle collection system according to claim 1, further comprising a water vapor generation device to supply a water vapor to the charging device, wherein a supply rate of the water vapor that is supplied from the water vapor generation device is approximately 0.20 to 0.50 mg/minute per 1 $cm^2$ of cross-sectional area of a wind path that passes through an electrode portion of the charging device.

3. The particle collection system according to claim 2, wherein a fixing device that heats, presses, and fixes a developer on a transfer material also functions as the vapor generation device.

4. The particle collection system according to claim 3, wherein the discharging electrode comprises protrusions for discharging at even intervals, and a tip end shape of each of the protrusions has a radius of curvature that is greater than an average diameter of the developer.

5. The particle collection system according to claim 3, wherein the high voltage applied to the discharging electrode has a polarity opposite to a charging polarity of the developer, and wherein the high voltage is controlled so that a current conduction amount between the discharging electrode and the counter electrode becomes a predetermined amount.

6. The particle collection system according to claim 3, wherein an ejection and conveyance path of the transfer material for which image formation is terminated also functions as an introduction route of the air flow for transporting the floating fine particles.

7. The particle collection system according to claim 3, wherein the image forming apparatus is to perform an electrophotographic process.

8. The particle collection system according to claim 1, wherein the opening diameter of the tubular ventilation passage is greater than or equal to approximately five percent of the gap between the discharging electrode and the counter electrode.

9. The particle collection system according to claim 8, wherein a product of the opening diameter of the tubular ventilation passage and the gap between the discharging electrode and the counter electrode is less than or equal to approximately twenty millimeters.

10. A particle collection system of an imaging apparatus, comprising: an air flow generation device to generate an air flow for transporting airborne particles;

a charging device that is located upstream of the air flow generation device in a ventilation direction to charge the floating fine particles in the air flow, wherein the charging device comprises a discharging electrode and a counter electrode; and a particle collection device that is located downstream of the charging device in the ventilation direction to collect the airborne particles which are charged by the charging device, wherein the particle collection device includes a tubular ventilation passage, wherein a length of the tubular ventilation passage in the ventilation direction is greater than an opening diameter of the tubular ventilation passage, and wherein the opening diameter of the tubular ventilation passage is less than or equal to a gap between the discharging electrode and the counter electrode.

11. The particle collection system according to claim 10, wherein the discharging electrode is connected to a high-voltage power supply.

12. The particle collection system according to claim 11, wherein the tubular ventilation passage is formed by stacking polymer sheets which are subjected to electret treatment.

13. The particle collection system according to claim 11, wherein the opening diameter is greater than or equal to approximately five percent of the gap.

14. The particle collection system according to claim 13, wherein a product obtained by multiplying the opening diameter and the gap is less than or equal to approximately twenty millimeters.

15. The particle collection system according to claim 10, wherein the counter electrode comprise a flat plate-shaped counter electrode that is disposed in parallel to a lateral surface of the discharging electrode.

* * * * *